US006035169A

United States Patent [19]

Miyake et al.

[11] Patent Number: 6,035,169

[45] Date of Patent: Mar. 7, 2000

[54] DEVELOPING DEVICE

[75] Inventors: Koji Miyake; Hideaki Tanaka; Takuji Matsumoto, all of Nakai-machi, Japan

[73] Assignee: Fuji Xerox Co., Ltd., Tokyo, Japan

[21] Appl. No.: 09/229,175

[22] Filed: Jan. 13, 1999

[30] Foreign Application Priority Data

Feb. 26, 1998 [JP] Japan ..... 10-62267

[51] Int. Cl.[7] ..... G03G 15/00

[52] U.S. Cl. ..... 399/258; 399/272; 399/282

[58] Field of Search ..... 399/258, 260, 399/262, 272, 281, 282

[56] References Cited

U.S. PATENT DOCUMENTS

| | | | |
|---|---|---|---|
| 4,595,277 | 6/1986 | Maczuszenko et al. | 399/260 X |
| 5,689,782 | 11/1997 | Murakami et al. | 399/281 |
| 5,708,942 | 1/1998 | Sugiyama et al. | 399/282 |
| 5,765,080 | 6/1998 | Bogoshian | 399/274 X |
| 5,768,666 | 6/1998 | Ito et al. | 399/260 X |
| 5,832,350 | 11/1998 | Kumasaka et al. | 399/282 |
| 5,943,537 | 8/1999 | Ahn | 399/254 |

FOREIGN PATENT DOCUMENTS

| | | |
|---|---|---|
| 59-111664 | 6/1984 | Japan . |
| 63-287874 | 11/1988 | Japan . |
| 5-59427 | 8/1993 | Japan . |
| 7-84456 | 3/1995 | Japan . |
| 7-128983 | 5/1995 | Japan . |
| 9-43993 | 2/1997 | Japan . |

*Primary Examiner*—Arthur T. Grimley
*Assistant Examiner*—Quana Grainger
*Attorney, Agent, or Firm*—Oliff & Berridge, PLC

[57] ABSTRACT

In a developing device comprising a developing member for transferring toner onto an electrostatic latent image for visualization, and a developer supplying member for magnetically attracting two-component developer on the peripheral surface for conveyance, and supplying two-component developer or toner to the developing member, the developer will be sufficiently agitated on the developer supplying member, and toner density and amount of toner charge in the two-component developer will be controlled with simple structure. A part of two-component developer, to which toner has been supplied on the developer supplying member, is caused to flow back on the upstream side in the conveying direction within a range in which the attracting force of magnetic poles of the internal member which the developer supplying member has acts. The internal member is caused to be rotationally moved, and a fluctuating magnetic field is formed between the internal member and the magnet arranged to face to it to thereby cause the reflux. Also, a rotating member which mechanically causes the reflux may be provided. Further, it may be possible to rotationally move the magnetic poles of the developer supplying member and to form an alternating electric field between the developer supplying member and an electrode opposite thereto for thereby causing the reflux.

33 Claims, 14 Drawing Sheets

DEVELOPING DEVICE

BACKGROUND OF THE INVENTION

Detailed Description of the Invention

1. Technical Field of the Invention

The present invention relates to a developing device used in an electrophotographic recording apparatus, an electrostatic recording apparatus or the like, for selectively transferring toner on a latent image based on an electrostatic potential difference for visualizing, and more particularly to a developing device using two-component developer obtained by mixing carrier with toner.

2. Related Art

In an electrophotography method, a developing method using the two-component developer containing toner and magnetic carrier has the advantages that it is easy to charge toner and flocculation of toner particles is also difficult to occur. For this reason, it has been more frequently used than before although it is necessary to control an amount of toner contained in the two-component developer, i.e., toner density.

FIG. 25 is a schematic structural view showing a conventional example of a developing device using two-component developer.

This developing device comprises: a developing roll 202 arranged in proximity to an image carrier 201 to face it, for magnetically attracting and conveying developer; a developer regulating member 203 for regulating an amount of developer attracted on the developing roll to provide a substantially uniform magnetic brush; a paddle 204 for supplying developer to the developing roll 202, and two augers 205 and 206 for conveying and agitating developer within a housing 210.

The foregoing developing roll 202 comprises a magnet roll 211 fixedly supported, and a cylindrical sleeve 212 rotationally driven around the magnet roll so that the magnet roll 211 attracts the developer on the sleeve to convey the developer to an opposite portion to the image carrier 201 by the rotation of the sleeve 212.

The foregoing two augers 205 and 206 rotate so as to convey the developer in the directions opposite to each other respectively within two agitation chambers 207 and 208 provided behind the developing roll 202, and the developer is circulated and moved within the two agitation chambers which are conductively connected to each other at their both ends.

In such a developing device, carrier and toner are sufficiently agitated within the agitation chambers 207 and 208, and a part of the developer is supplied to the developing roll 202 by the paddle 204. This developer is attracted on the sleeve 212 by a pickup magnetic pole 213 of the magnet roll 211, and the layer thickness is regulated by a developer regulating member 203, and thereafter the developer is conveyed to a developing area to be used for development.

The developer, which has passed through the developing area, is released from the sleeve 212 by a pick-off magnetic pole 214, and is returned to the agitation chamber by the paddle 204. It is mixed with the other developer and toner newly replenished here to be sufficiently agitated.

An amount of charge of toner in the developer used in such a developing device fluctuates depending upon the environmental conditions, and also greatly fluctuates depending upon the toner density in the developer. FIG. 26 shows relationship between the toner density and the amount of charge of the toner within such a two-component developing device as described above under each environmental condition of high temperatures/high humidities, intermediate temperatures/intermediate humidities, and low temperatures/low humidities. Generally, the amount of toner charge fluctuates with such characteristics as shown in FIG. 26, and the amount of toner charge must be maintained constant in order to obtain fixed development characteristics under each environmental condition. To this end, it is necessary to perform the following control.

That is, when the operating environment changes from high temperatures/high humidities (state indicated by a symbol a in FIG. 26) to intermediate temperatures/intermediate humidities (state indicated by a symbol b' in FIG. 26), toner must be replenished to increase the toner density from A to B so that the amount of toner charge becomes a predetermined value (state indicated by a symbol b in FIG. 26). Also, when the environmental condition changes from low temperatures/low humidities (state indicated by a symbol c in FIG. 26) to intermediate temperatures/intermediate humidities (state indicated by a symbol d in FIG. 26), the toner density must be reduced from C to B so that the amount of toner charge becomes a predetermined value (state indicated by a symbol b in FIG. 26). In the conventional two-component developing device, however, there have had a problem that there is no method for reducing the toner density except consuming the toner, but the amount of toner charge becomes low, causing fog on the background.

Also, in order to control such toner density, a reference image has been actually developed to detect the density, and control, in which toner is replenished among others, has been performed, and a complicated control method and device therefor have been required. Under such circumstances, a developing device, in which an attempt is made to obtain an image with stable density by controlling the toner density by a simple mechanism, is described in, for example, Japanese Published Unexamined Patent Application Nos. Sho 59-111664 and 63-287874, Japanese Published Unexamined Patent Application No. Hei 5-59427, and Japanese Published Unexamined Patent Application No. Hei 7-84456.

A developing device according to the technique described in the Japanese Published Unexamined Patent Application No. Sho 59-111664 comprises: a magnetic conveying part consisting of a magnet roller and a non-magnetic sleeve provided apart from it on an outer peripheral surface thereof; and such a rotatable toner supply roller as to come into contact with bristle of the developer formed on the foregoing non-magnetic sleeve, and the foregoing toner supply roller is caused to abut upon a toner layer thickness regulating member (blade) to form a thin layer of toner charged on the surface of the foregoing toner supply roller. On replenishing toner to the developer on the non-magnetic sleeve from the toner supply roller, a predetermined level of potential difference is imparted between the foregoing non-magnetic sleeve and the foregoing toner supply roller to control an amount of toner movement from the surface of the foregoing toner supply roller to the foregoing non-magnetic sleeve whereby the toner density is caused to be maintained substantially constant.

According to the technique described in the Japanese Published Unexamined Patent Application No. Sho 63-287874, developer conveyed by the developing roll is regulated to a desired thickness by a regulating plate, the developer separated from the developing roll is caused to fall by gravity within a vessel, and this developer which has fallen is conveyed by the developing roll again. Thus, circulation of the developer is formed, and the toner density is caused to be maintained constant by causing toner to intermittently come into contact with the developer circulating.

According to the technique specified in the Japanese Published Unexamined Patent Publication No. Hei 5-59427, bristle of a magnetic brush on the sleeve is caused to slidably contact a mesh screen arranged at the opening of a toner hopper, whereby the toner within the toner hopper is caused to move to the foregoing magnetic brush for self-adjustment of the toner density.

According to the technique specified in the Japanese Published Unexamined Patent Application No. Hei 7-84456, the surroundings of the developing roller are regarded as a narrow space, and the amount of carrier within this space is set to a substantially constant value, whereby the amount of the magnetic toner contained in the remaining space is adjusted to thereby control the toner density substantially constant.

In this respect, there has also been reported in large numbers a device in which the toner density is not adjusted unlike the foregoing, but charging of the toner in the developer is promoted with a simple mechanism. According to the technique specified in, for example, Japanese Published Unexamined Patent Application No. Hei 9-43993, in a device for causing a magnet roller to rotate for conveying developer, a magnet member having a plurality of magnetic poles is caused to oppose to the developer which has passed through the toner supply area, and an alternating magnetic field is formed in the area opposite thereto, to thereby increase the agitating force of the developer.

Problems to Be Solved by the Invention

However, such a developing device as described above has the following problems. In a developing device specified in the Japanese Published Unexamined Patent Application No. Sho 59-111664, a thin layer of toner charged is formed on the foregoing toner supply roller by urging the toner layer regulating member against the toner supply roller. For this reason, a strong frictional force acts between the foregoing toner layer regulating member and the toner, the toner is turned into a film on the foregoing toner supply roller, replenishment of toner from the toner supply roller to the developing roller will not be smoothly performed, or defective charging of toner will occur.

In a developing device specified in the Japanese Published Unexamined Patent Application No. Sho 63-287874, in order to circulate developer, the developer is caused to completely separate from the developing roll, and to fall by gravity, and is raised upwardly by the foregoing developing roller again. Therefore, there are the problems that the developer on the developing roll cannot be agitated quickly, and a considerably wide space is required for the circulation of the developer.

Also, in order to sufficiently agitate the developer circulating, it is necessary to set the magnetic force of the developing roll to be strong, and to that end, there is the problem that deteriorated developer occurs in a portion of shaping the magnetic brush. Also, a great difference occurs in an amount of toner replenished between when a solid image having gradation such as a photograph, a picture, a map and the like is mainly printed, and when a line image is mainly printed. In a system of circulating the developer, however, a mechanical rotary motion of developer causes a fixed amount of toner to be taken in at all times, and therefore there is the problem that the amount of toner supply cannot be varied in conformity with the image printed so that it becomes difficult to maintain the toner density constant.

A developing device specified in the Japanese Published Unexamined Patent Publication No. Sho 5-59427 has the problem that since developer slidably contacts a mesh screen, stress is applied to the developer, leading to much shortened life of the developer. Also, since the fluidity of toner and the charging property of the toner, i.e., an adhesive force between toner and carrier greatly contribute to the control of toner density, there is the problem that the toner density control range will be beyond a range set at the beginning and the printed image quality will be different from that at the beginning if the fluidity and charging property of the toner change depending upon the environment or elapsed time.

Also, a great difference occurs in an amount of toner replenished between when a solid image having gradation such as a photograph, a picture and a map is mainly printed, and when a line image is mainly printed. In the mesh screen system, however, the contact area between carrier and toner is limited, and therefore, it becomes difficult to maintain the toner density constant when the amount of toner thus replenished fluctuates greatly.

Further, toner is replenished to the developer while a magnetic brush is formed on the magnet roll, and since the developer is usually in a flocculated state, the effective contact area of the carrier is reduced, and defectively-charged toner is prone to occur.

In a developing device specified in the Japanese Patent Laid-Open Application No.7-84456, magnetic toner is used and it is necessary to cause toner to contain magnetic powder, but there is the problem that magnetic powder cannot be mixed with color toner because of a problem concerning coloring property and the color toner cannot be used. In a case where great importance is placed on the coloring property and non-magnetic toner is used for the present developing device, any force for attracting toner to the developing roll by means of a magnetic force does not act, but further for a reason that a difference in specific gravity between the non-magnetic toner and the magnetic carrier is large and other reasons, agitation of the non-magnetic toner and the magnetic carrier within a narrow space around the developing roller will not be sufficiently performed. This leads to the problems that the toner is insufficiently charged, and toner cannot be sufficiently replenished to the developer supplied to the development area.

The present invention has been achieved in the light of the above-described problems, and is aimed to provide a developing device capable of promoting toner charging by sufficiently agitating developer, to which toner has newly been replenished, on a developer supplying member, or in addition thereto, controlling the toner density and the amount of toner charge in the two-component developer with simple structure, and obtaining good image quality with stability even when the environmental conditions fluctuate and when the amount of toner used fluctuates depending on a difference in the originals.

SUMMARY OF THE INVENTION

Means for Solving the Problems

In order to solve such problems as described above, a developing device according to the present invention comprises: a developing member for carrying two-component developer or toner separated from two-component developer on a peripheral surface, which circumferentially moves, to convey it to an opposite position to the image carrier, and for transferring the foregoing toner onto an electrostatic latent image on the image carrier; and a developer supplying member provided facing to this developing member, for conveying, in the circumferential direction, two-component developer attracted on the foregoing peripheral surface by a plurality of magnetic poles magnetized along the endless peripheral surface to supply the two-component developer or the toner in the two-component developer to the foregoing developing member, so that a part of the two-component developer carried on the peripheral surface of the foregoing developer supplying member is caused to flow back on the upstream side in the conveying direction within a range in which the attracting force of the magnetic pole, which the developer supplying member has, acts. Toner is supplied to an area to which the developer is flowed back, or on the upstream side thereof.

In such structure as described above, the reflux mechanism that a flow in the direction opposite to the conveying direction of the developer by the developer supplying member is imparted to a part of the two-component developer carried on the foregoing developer supplying member to thereby move the part of the foregoing two-component developer on the upstream side of the foregoing conveying direction in the vicinity of the peripheral surface of the developer supplying member.

In such a developing device, two-component developer containing toner and magnetic carrier is magnetically attracted on the developer supplying member, and is conveyed in a brisle shape in the circumferential direction, and toner is newly supplied by a toner supplying part as the toner in this two-component developer is consumed. Thus, in the two-component developer, to which toner has been supplied, a bristle-shaped chain is collapsed by a developer refluxmechanism, and a part thereof is conveyed on the upstream side.

At this time, a force in a random direction acts on the particles of developer, and the magnetic carrier is dispersed and agitated to increase the opportunity to contact the toner for promoting frictional charging. In addition, the developer is flowed back on the upstream side, whereby the developer is agitated in a wide range so that the developer carried on the developer supplying member is uniformly agitated and charged.

Also, new toner is supplied to this reflux area or on the upstream side thereof, and is supplied particularly to the upstream portion of the reflux area of the developer supplying member in the developer conveying direction, whereby the toner supplied is mixed and agitated immediately, and a range in which the toner, which is not sufficiently charged, is crowded, is restricted. Therefore, diffusion of the toner crowd is prevented, and an image developed is prevented from being contaminated.

Further, since such reflux is performed within a range in which the magnetic attracting force of magnetic pole, which the developer supplying member has, reaches, there is no need for a large space within the developing device, but the developer agitated is smoothly returned to the chain on the developer supplying member.

The two-component developer, to which toner has been supplied, and, which has sufficiently been charged as described above, is conveyed on the developer supplying member, the two-component developer or toner alone is transferred at an opposite portion to the developing member, and is carried on the developing member to be conveyed to the opposite portion to the image carrier. Thus, the toner is transferred onto an electrostatic latent image on the image carrier to form a visible image.

For the foregoing developing member, there can be adopted a developing member which magnetically attracts two-component developer transferred from the developer supplying member for conveying, a developing member which transfers only the toner in the two-component developer from the developer supplying member, and electrically attracts this toner for conveying, and the like, but it is preferable to use a developing member in which a plurality of magnetic poles are magnetized at regular intervals of 25 $\mu$m to about 250 $\mu$m on the peripheral surface. Such developing member is capable of substantially uniformly attracting almost one-layer magnetic carrier on the peripheral surface thereof by setting the strength of each magnetic pole appropriately.

Therefore, a uniform thin layer of two-component developer can be formed without using any member of regulating the layer thickness, and deteriorated developer can be reduced. Also, after passing through the opposite position (development area) to the image carrier, it is possible to easily recover from the developing member, and deteriorated developer can be effectively reduced.

In the foregoing developing device, by controlling the amount of toner supplied, the toner density of the two-component developer transferred onto the developing member is set to a predetermined value, whereby it is possible to form a good image without density fluctuations. However, toner is supplied more than the amount of saturation which carrier is capable of electrically attracting, from the toner supplying part, whereby it becomes possible to perform development without density fluctuations more easily and reliably. More specifically, two-component developer, to which toner has been supplied in excess amounts, is partially flowed back on the developer supplying member as described above, whereby toner with low adhesive force with carrier is separated, and carrier is supplied to the developing member with toner, adhered thereto, of the amount of saturation, which carrier is capable of electrically attracting. Thereby, the toner density and the amount of toner charge of the developer supplied to the developing member are controlled by the amount of charge of carrier, and become substantially constant. In other words, since the amount of charge of carrier becomes substantially constant irrespective of the environmental conditions, an image with stable density can be formed even if the environmental conditions fluctuate.

The reason why environmental resistance is exhibited as described above is considered as follows: that is, when attention is paid to charging property of carrier and that of toner, the charging property of toner exhibits higher dependence on the environment. This is because there is a high probability that polymer scission chains exist on the surface of toner from its production method, the scission chains easily react with water because of its activity, and are susceptible to environmental fluctuations. On the other hand, since it is usually coated with coating material, carrier is resistant to environmental fluctuations unlike toner. Therefore, in the conventional system, there are a small amount of toner in the developer and the amount of charge of the developer is unsaturated with respect to the charging ability of the carrier, and therefore, the charging property of toner becomes predominant, and becomes dependent on the environment.

In this system, however, toner is supplied in excess amounts, and the individual particles of carrier agitate the developer in a comparatively dispersed state, and therefore, the toner can be caused to be attracted to carrier to such a degree that the surface of carrier is not exposed by frictional charging of the toner and carrier. For this reason, the amount of charge of the developer becomes saturated with respect to the charging ability of the carrier, and the charging property of the carrier becomes predominant and is not dependent on the environment.

In such developing devices as described above, there is a developing device using a fluctuating magnetic field as one of parts for flowing back developer in the vicinity of the developer supplying member.

In this developing device, the developer supplying member comprises: an internal member, over the entire circumference of which endless peripheral surface, N-poles and S-poles are alternately magnetized, and whose peripheral surface is supported so as to be able to circumferentially move; and an endless outer peripheral member supported in the outside of the peripheral surface of the internal member, and the foregoing internal member is assumed to be rotationally driven so that the foregoing two-component developer layer, which has been magnetically attracted on the peripheral surface of the foregoing outer peripheral member, which is at rest or circumferentially driven, and has become bristle-shaped, is tumbled, agitated and conveyed on the foregoing outer peripheral member. As a developer refluxmechanism, a magnet, an electromagnet or a magnetic member is arranged to oppose to the developer supplying member so that fluctuating magnetic fields are formed between a plurality of magnetic poles formed in these members and the developer supplying member to flow back the developer.

In such a developing device as described above, in the two-component developer attracted on the peripheral surface of the developer supplying member, the magnetic carrier is caused to stand erect in a bristle shape, and the magnetic poles of the internal member circumferentially move to thereby intensely repeat the operation in which the bristles of the magnetic carrier fall and are caused to stand erect again. Thus, such tumbling causes the carrier, which was in the upper portion of the bristles, to move to the lower portion thereof, and the carrier, which was in the lower portion, to move to the upper portion, and conveys the two-component developer in the direction opposite to the circumferential direction of the internal member as well as sufficient agitation.

On the other hand, at the position where the magnet, the electromagnet or the magnetic member has been arranged to oppose to the developer supplying member, in addition to the tumbling of the developer which has become bristle-shaped as described above, there are formed chains in which the magnetic carrier in the two-component developer is spanned like a bridge between the magnetic poles of the internal member and the magnetic poles opposite thereto. These chains move, with the movement of the internal member, in the same direction, and disappear as the magnetic poles of the internal member go away.

The operation, in which such chains are formed on the upstream side of the internal member in the circumferential direction, move together with the magnetic poles and disappear on the downstream side, is repeated, and the two-component developer is conveyed in the rotating direction of the internal member.

Accordingly, because of the tumbling on the foregoing developer supplying member, a flow of developer moving in the direction opposite to the circumferential direction of the internal member and a flow of the internal member in the circumferential direction, which occurs between the foregoing magnetic poles opposite to each other, will coexist, and a part of the developer will be caused to flow back on the upstream side in the conveying direction. In such an operation, the developer is subjected to an intense disturbing action, and is sufficiently mixed with newly supplied toner to be charged.

As regards a magnet or an electromagnet arranged so as to oppose to the developer supplying member as the foregoing developer reflux part, the positions, interval, strength and the like of its magnetic poles can be appropriately set. In the case of using a magnet, it is not limited to a magnet fixedly arranged, but a part in which a plurality of magnetic poles are provided at the outer peripheral portion of the member, which rotates, and these magnetic poles circumferentially move may be used. In a developer reflux part using an electromagnet, it may be possible to cause it to fluctuate while appropriately controlling the strength, direction and the like of an electric current which flows through the coil.

On the other hand, in a developer reflux part using a magnetic member, the shape, dimensions, arrangement positions and the like of the magnetic member can be appropriately set so that magnetic poles induced by the magnetic poles of the internal member have appropriate positions and strength.

As another part for flowing back the developer in the vicinity of the developer supplying member, there is a developer reflux part in which a member rotationally driven so as to oppose to the developer supplying member is arranged and the developer is caused to flow back on the upstream side of the developer supplying member in the conveying direction by means of the rotational driving force of this member.

In a developing device having such a developer reflux part, a rotating member is arranged so as to come into contact with developer within a range in which a magnetic attracting force of the developer supplying member acts, and this rotating member is rotationally driven so that the outer peripheral portion of this member moves in the direction opposite to the conveyance direction of the developer at a position opposite to the developer supplying member. Such an operation causes the developer to flow in the direction opposite to the conveyance direction, that is, to flow back.

As the foregoing rotating member, members having various forms can be adopted, and there are brush-shaped members, roll-shaped members and the like. In the roll-shaped member, a plurality of projections or a wing-shaped member may be provided on the peripheral surface in order to enhance the effect of conveying developer.

Such a developer reflux part has a high degree of freedom in view of setting an amount of reflux, a reflux velocity and the like because a force of conveying the developer in the direction opposite to the conveyance direction of the developer by the developer supplying member is imparted by a member in direct contact with the developer, and it becomes possible to control the reflux action with stability.

Also, as a part of flowing back the developer by the use of the driving force of the rotating member, there is a part in which a roll-shaped magnet provided with a plurality of magnetic poles along the peripheral surface is used. This causes the developer to flow back by magnetically attracting the developer on the peripheral surface and rotating so that the peripheral surface moves in the direction opposite to the conveyance direction of the developer.

Further, the following structure may be adopted.

In the outside of an internal member, along the peripheral surface of which a plurality of magnetic poles are provided, a thin outer peripheral member is provided along this internal member. Thus, the internal member is rotationally driven, and the outer peripheral member is caused to stand still or to be rotationally driven in the direction opposite to the internal member. By such structure, btistle of the magnetic carrier of the developer is formed on the outer peripheral member, and collapse/standing-erect of this britle are repeated by rotation of the internal member—so-called tumbling is caused, and the developer moves inversely to the rotating direction of the internal member. By the use of this force, the developer can be also flowed back on the upstream side of the developer supplying member in the conveying direction.

In this respect, in a part for causing a reflux by means of the driving force of a rotating member provided facing to the developer supplying member as described above, the structure of the developer supplying member is not particularly restricted, but it will suffice only if it magnetically attracts the developer for conveying. In addition to a member in which the internal member having a plurality of magnetic poles rotates relatively with respect to the outer peripheral member, there may be also used a member in which the internal member having a plurality of magnetic poles is fixedly arranged and the outer peripheral member arranged in the outside thereof is rotationally driven to thereby convey the developer, or the like.

As another part for flowing back the developer in the vicinity of the developer supplying member, there is a part in which a magnetic field caused by the internal member of the developer supplying member and an electric field formed in the vicinity of the developer supplying member are utilized.

In a developing device having such a developer reflux part, there is used a developer supplying member, comprising: an internal member, over the entire circumference of which endless peripheral surface, N-poles and S-poles are alternately magnetized, and whose peripheral surface is supported so as to be able to circumferentially move; and an endless outer peripheral member supported in the outside of the internal member. The vicinity of the peripheral surface of the outer peripheral member or the internal member is constituted by conductive material, and AC bias voltage is applied between this developer supplying member and an electrode arranged facing thereto. The peak value and frequency of this bias voltage are set so that a part of the two-component developer frictionally charged retracts from the bristle-shaped chains of developer formed on the developer supplying member for reciprocating.

In such a developing device, a developer layer, in which the magnetic carrier has become bristle-shaped, is formed on the outer peripheral member of the developer supplying member, and the internal member is rotationally driven whereby while the tumbling of britle-shaped chains of the magnetic carrier, consisting of falling down and standing erect again, is being repeated, the developer is conveyed in the direction opposite to the direction of rotation of the internal member. This is the same operation as described in the previous example. Thus, in this developing device, an AC electric field is formed between the developer supplying member and the electrode, and this electric field causes a part of the developer frictionally charged to retract from the bristle for starting reciprocation. When thus retracted from the bristle, only the magnetic attracting force due to the magnetic poles of the internal member, which is circumferentially moving, acts without being affected by the tumbling on the outer peripheral member. For this reason, the developer, which is reciprocating, moves in the same direction as the circumferential direction of the internal member, and is caused to flow back on the upstream side of the developer on the outer peripheral member in the conveying direction.

The developing device described above causes a part of the two-component developer conveyed on the developer supplying member to flow back on the upstream side in the conveying direction. The present invention includes also a developing device comprising a hold-back member for holding back a part of the two-component developer conveyed on the developer supplying member in such a manner that the developer, which is held back and stays, is caused to flow back on the upstream side within a range in which the magnetic attracting force of the developer supplying member reaches.

In such a developing device, as a part for causing the two-component developer held back to flow back, there can be adopted a part in which there is provided a member, which rotates in contact with the developer, and the developer is caused to flow back by means of the rotational driving force of this member, a part in which there is provided an electrode substantially parallel to the developer supplying member in the two-component developer held back, and when this electrode is electrically energized, the developer containing magnetic carrier is caused to flow back by means of a magnetic field formed in the vicinity, and the like.

In such a developing device, at least a portion of bristle of the developer formed on the developer supplying member is collapsed by a hold-back member, and further the developer collapsed is caused to flow back, whereby the individual particles of carrier enter a comparatively-dispersed state, and it becomes possible to form a large carrier surface capable of contacting the toner. At the same time, in the area where the developer has been collapsed, both a force of the developer conveying member for conveying the developer and a force for causing it to flow back cause the developer to enter an agitated state. Thus, toner is supplied to the area where the developer has been collapsed, whereby the toner, which has contacted the carrier, is charged to attract, and at the same time, the toner having low adhesive force with carrier is separated from the carrier by the agitating action of the developer. The amount of charge of the carrier at this time becomes substantially constant irrespective of the environmental conditions as described previously, and the average amount of charge of toner particles adhering thereto, and the amount of toner also become substantially constant. Also, the developer held back is caused to flow back, whereby it is possible to easily control and adjust the amount of developer which flows back.

In this respect, the foregoing hold-back member is adjusted so that the amount of developer held back becomes a fixed amount unlike such a conventional developer layer thickness regulating member as called "trimmer", and this amount is set to such a degree that high pressure does not act on the developer. Therefore, the developer will not be deteriorated when it is held back, but a good image will be maintained for a long period of time.

Even in such a developing device as described above, the developer supplying member comprises: an internal member, over the entire circumference whose endless peripheral surface, S-poles and N-poles are alternately magnetized, and whose peripheral surface is supported so as to be able to circumferentially move; and an endless outer peripheral member supported in the outside of the peripheral surface of the foregoing internal member, and a two-component developer layer, which has been magnetically attracted on the foregoing outer peripheral member and has become bristle-shaped, is caused to tumble by means of circumferential movement of the foregoing internal member, and is conveyed in the direction opposite to the direction of rotation of the internal member to thereby obtain desired results. In other words, on the peripheral surface of the outer peripheral member, tumbling of the developer for attracting the tip end portions of britles of the two-component developer to the surface and moving the carrier, which was in the lower portions of the bristles, to the tip end portions of the bristles is repeatedly caused as described above, whereby it is possible to sufficiently agitate the developer after passing through the developer reflux area, and as a result, uniform dispersion of the toner is appropriately performed.

In all the developing devices according to the present invention described above, a substantially fixed amount of two-component developer carried on the peripheral surface of the developer supplying member for conveyance is caused to flow back at all times.

For this reason, substantially stabilized dispersion of developer is always performed in the developer reflux area, and the amount of toner attracted by carrier also becomes substantially constant. Further, the developer, which has passed through the developer reflux area, is supplied to the process on the downstream side while the layer thickness thereof is substantially constant at all times. As a result, the density of the developer and toner which are conveyed to the development area also becomes stable, thus causing no defects such as uneven image density.

In this respect, the amount of the developer flowed back in the developer reflux area can be controlled by the amount of developer inputted at the initial stage, the magnetic pole pitch of the developer supplying member, the magnetic flux density of each magnetic pole, rotational speed, the structure of the developer reflux part and the like.

DETAILED DESCRIPTION OF PREFERRED EMBODIMENTS

Embodiments of the Invention

Hereinafter, with reference to the accompanying drawings, the description will be made of embodiments according to the present invention.

Figure 1:
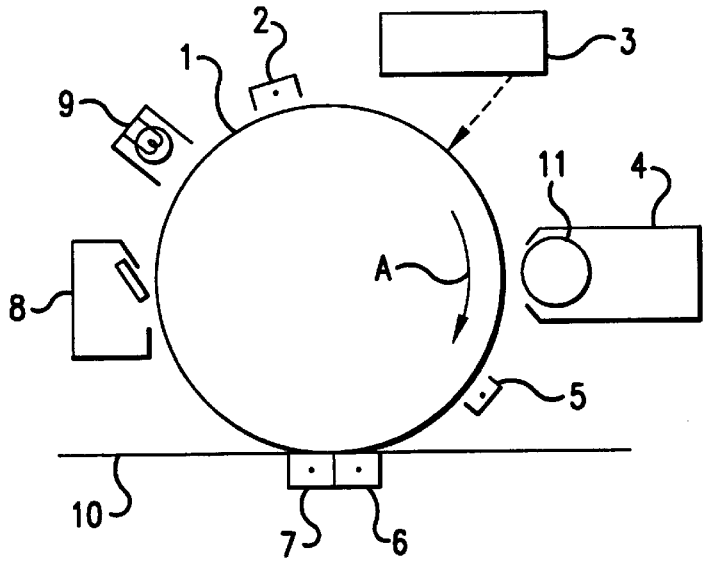
FIG. 1 is a schematic structural view showing an embodiment of an image forming apparatus to which a developing device according to the present invention is applied.

FIG. 1 is a schematic structural view showing an embodiment of an image recording apparatus to which a developing device according to the present invention is applied.

In FIG. 1, a reference numeral 1 designates a photoreceptor drum as an image carrier, and this photoreceptor drum 1 is provided with a photoreceptor layer on the surface of a cylindrical member made of conductive material, and is adapted to be rotationally driven in a direction indicated by an arrow A in the figure. Also, around the photoreceptor drum 1, there are provided, along its rotating direction, a charger 2, an exposure device 3, a developing device 4 having a developer carrier 11 (developing roll) consisting of a cylindrical member opposed to the photoreceptor drum 1, a pre-transfer corotron 5, a transfer corotron 6, a peeling corotron 7, a cleaner 8 and an optical de-electrifier 9.

The conductive substrate of the foregoing photoreceptor drum 1 is electrically grounded. Also, a negatively-charged organic photoreceptor (OPC) is used for the photoreceptor, and when image light is irradiated after charged substantially uniformly, the charge on the exposure portion flows through the foregoing conductive substrate to attenuate the potential. This photoreceptor drum 1 can be set to, for example, 100 mm in outside diameter and about 160 mm/s in moving speed of the peripheral surface, i.e., process speed.

The foregoing exposure device 3 has a laser generator which flickers on the basis of an image signal, and a polygon mirror which reflects while rotating laser beam emitted from this laser generator to form an electrostatic latent image by exposure-scanning the peripheral surface of the photoreceptor drum 1. This exposure scanning may either expose the image portion or expose the non-image portion, and the charging polarity of the photoreceptor or that of the toner is appropriately selected to thereby transfer the toner onto the image portion for visualizing. In this image forming apparatus, for the photoreceptor and toner, negatively-charged ones are used, and it is set so as to expose the image portion.

Next, the description will be made of the operation of the foregoing image forming apparatus.

Figures 2A, 2B, 2C:
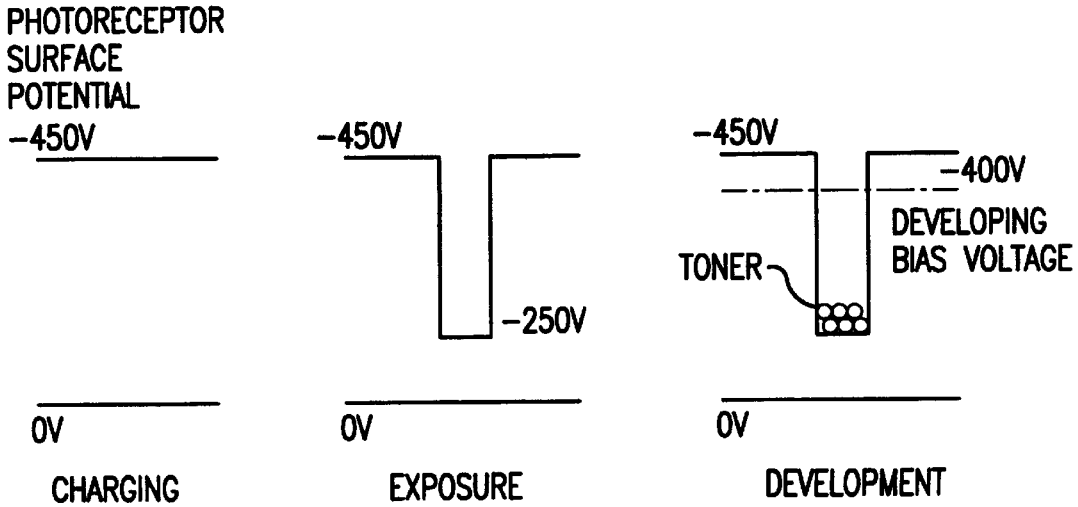
FIGS. 2(*a*)–2(*c*) are views showing changes of electric potential on the surface of an image carrier when a toner image is formed in the image forming apparatus shown in FIG. 1.

First, the surface of the photoreceptor drum 1 is uniformly charged at predetermined voltage (−450 V) by the charger 2 [FIG. 2(A)]. Next, the surface of the photoreceptor drum 1 is irradiated with image light by the exposure device 3 to form an electrostatic latent image having potential at the exposure portion of substantially −250 V [FIG. 2(B)]. This electrostatic latent image is toner-developed by the developing device 4 for visualization [FIG. 2(C)]. A developing roll 11 used in the foregoing developing device 4 is mainly constituted by a conductive layer and a magnetic recording layer formed on the top thereof, and this magnetic recording layer can be provided with a plurality of magnetic poles. Developing bias voltage is applied to this conductive layer, and an electric field is formed between the conductive layer and a latent image on the photoreceptor drum 1 to thereby transfer the toner onto the latent image.

The toner image formed on the photoreceptor drum 1 as described above is charged by the pre-corotron 5 as required, and is subsequently transferred onto a recording sheet 10 by charging of the transfer corotron 6. Thereafter, this recording sheet 10 is peeled from the surface of the photoreceptor drum 1 by charging of the peeling corotron 7, and is conveyed to a fixing device (not shown). In the fixing device, the toner image is heated and compressed to thereby be fixed on the recording sheet. On the other hand, after the termination of transfer process of the toner image and peeling process of the recording sheet, any residual toner is cleaned from the surface of the photoreceptor drum 1 by the cleaner 8, and further the residual charge is removed by exposure by the optical de-electrifier 9 to prepare for the next image recording process.

Next, the description will be made of a developing device according to an embodiment of the present invention.

Figure 3:
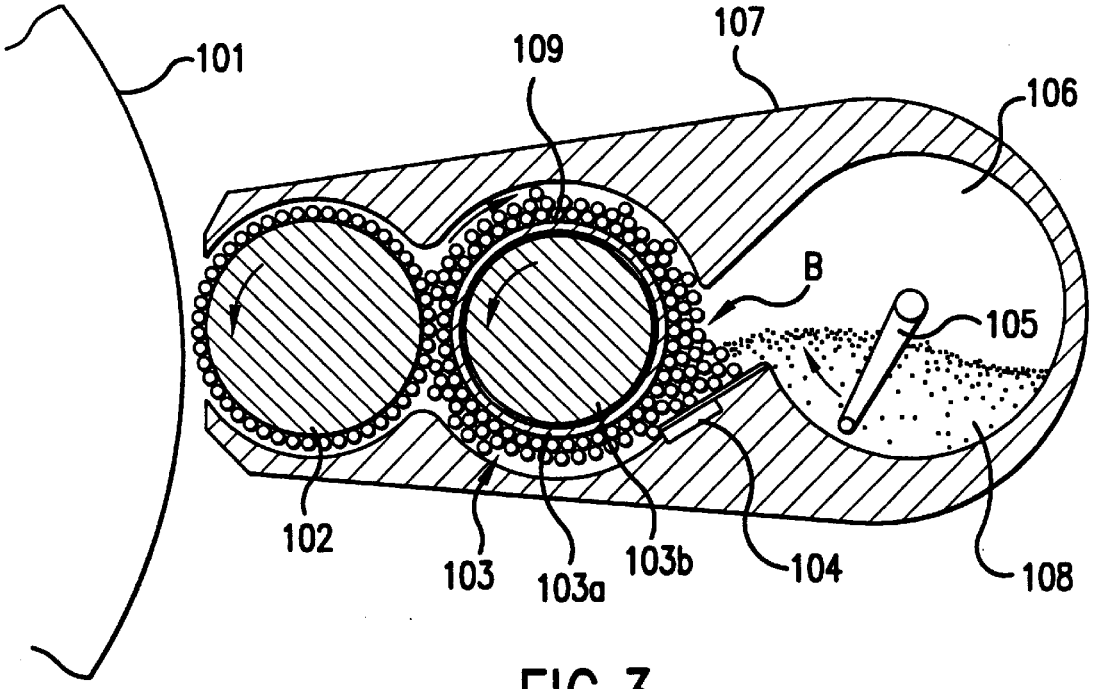
FIG. 3 is a schematic structural view showing a developing device according to an embodiment of the present invention.

FIG. 3 is a schematic structural view showing a developing device according to an embodiment of the invention specified in claims 1 to 7, claim 9 and claim 10 or claim 11.

This developing device comprises: within a housing 107 containing two-component developer, a developing roll 102 for carrying two-component developer on the peripheral surface thereof to convey to an area opposite to the photoreceptor drum 101; a supply roll (developer supplying member) 103 for conveying developer to a position opposite to the foregoing developing roll 102 while mixing and agitating it to supply the developer to the foregoing developing roll; a developer reflux part 104 for causing the two-component developer carried on the supply roll 103 to flow back; and a toner conveying member 105 for conveying toner 108 to a reflux area B while loosening the toner stored.

The foregoing supply roll 103 is constituted by a hollow, cylindrical non-magnetic sleeve (outer peripheral member) 103*a* rotatively supported and a magnetic field generating member (internal member) 103*b* located inside the non-magnetic sleeve. The foregoing sleeve 103*a* is formed of non-magnetic stainless steel having an outside diameter of 18 mm. The foregoing magnetic field generating member 103*b* is provided such that magnetic poles having different polarities are alternately magnetized throughout the circumference and the magnetic field generating member is capable of rotating independently of the sleeve 103*a* in the outside. On the peripheral surface, 18 magnetic poles are provided at intervals of about 3 mm so that N-poles and S-poles are alternately magnetized, and the maximum magnetic flux density (polar magnetic force) of each magnetic pole is 30 mT. The layer of developer attracted on the sleeve by such magnetic poles has a thickness of 650 $\mu$m on the magnetic pole, and 350 $\mu$m between the magnetic poles.

By rotation of both the internal member 103*b* and the sleeve 103*a* in the directions opposite to each other, a chain of developer, which has become bristle-shaped on the supply roll 103 constructed as described above, tumbles so that it repeats collapse and standing-erect on the sleeve, and moves in the direction opposite to the direction of rotation of the internal member 103*b* while being agitated to be conveyed to the area opposite to the developing roll 102.

The foregoing toner conveying member 105 is disposed in the toner containing portion 106 within the housing, and rotates in a direction indicated by an arrow in the figure to thereby sufficiently agitate the toner and to convey the toner to the reflux area B.

The foregoing developing roll 102 is a roll, on the peripheral surface of which, a plurality of magnetic poles are magnetized at infinitesimal intervals, and attracts two-component developer on the peripheral surface, and is rotationally driven to thereby convey the foregoing developer to the position opposite to the image carrier. The details of this developing roll will be described later.

Figure 4:
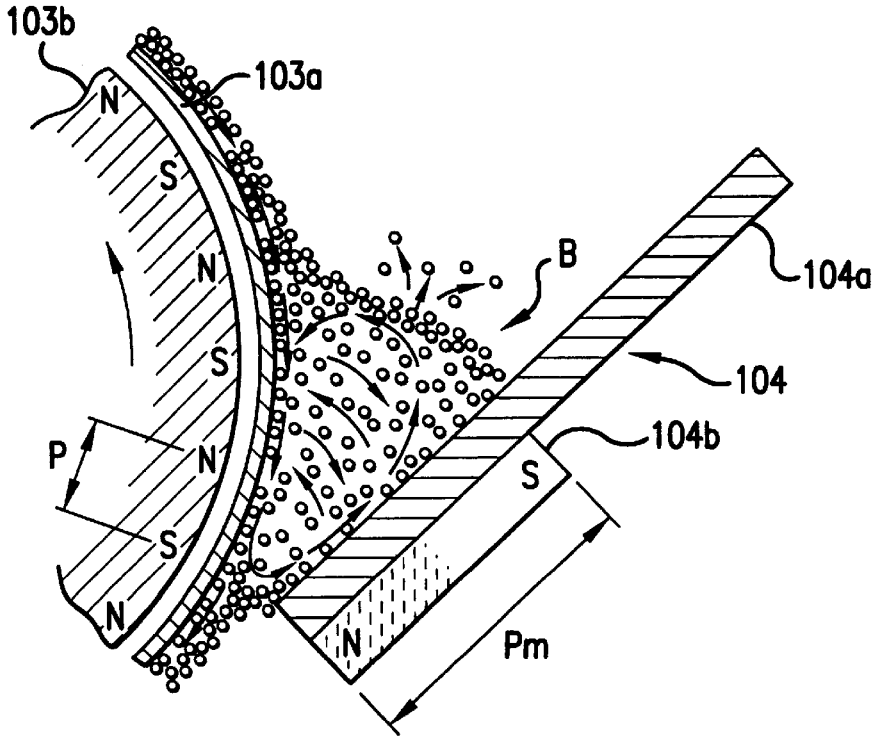
FIG. 4 is a view showing a flow of developer caused to flow back in the developing device shown in FIG. 3.

The foregoing developer reflux part 104 consists, as shown in FIG. 4, of a blade 104*a* made of non-magnetic stainless steel as an opposite member opposite to the supply roll 103, and a magnet member 104*b* magnetized in the direction of the width of the plate-shaped member made of ferrite. The magnet member 104*b* is provided at the tip end portion of the blade 104*a* so that its direction of magnetization is parallel with the blade surface, and in the present embodiment, its width (Pm shown in FIG. 4) is determined so that it satisfies relation of $Pm \geqq \frac{1}{4} P$ with the magnetic pole pitch (P shown in FIG. 4) of the magnetic field generating member 103*b* in the supply roll. Also, the magnetic field induced on the surface of the blade 104*a* by this magnet member 104*b* is such that the maximum value for the magnetic flux density in the direction perpendicular to the blade surface becomes substantially 700 G. In the present embodiment, the developer reflux part 104 is in proximity to the peripheral surface of the supply roll 103 at an angle of approximately 45° and its most proximate distance is set to 600 $\mu$m to 1500 $\mu$m. A magnetic field is generated between such developer reflux part 104 and the magnetic field generating member 103*b*, and this magnetic field is adapted to fluctuate by the rotation of the magnetic field generating member.

In this respect, in the present embodiment, the magnitude of the magnetic field on the surface of the foregoing blade 104*a* is such that the maximum value for the magnetic flux density in the direction perpendicular to the surface is substantially 700 G as described above, and the maximum value on the surface in the perpendicular direction can be 100 G to about 2000 G.

Also, the two-component developer used in the present embodiment is developer obtained by mixing non-magnetic polyester toner with ferrite magnetic carrier, and toner or carrier made of other material can be used. The carrier obtained by dispersing magnetic powder in polymer resin is lower in specific gravity than ferrite carrier, and has lower stress during agitation, and is preferable for the developer life. Toner formed by the polymerization method and the mixing and grinding method can be both used, and spherical toner with high fluidity is preferably used.

Next, the description will be made of the operation of a developing device according to the present embodiment.

In such a developing device as described above, developer carried on the supply roll 103 is supplied to the developing roll 102. Further, the developer is conveyed on the developing roll 102 to reach the development area. Predetermined developing bias voltage is applied between the photoreceptor drum 101 and the developing roll 102 to form an electric field in a development area to which they oppose, and the toner is transferred from the developer on the developing roll 102 onto the photoreceptor drum 101 to form a toner image in conformity with the latent image.

The developer, which has passed through the development area, is conducted to the toner reflux area B, and it is caused by the developer reflux part 104 to flow back the moment toner is supplied. The principle in which this reflux occurs will be described in detail later.

In the foregoing area B, a magnetic field acting on the developer is always fluctuating by the rotation of the magnetic field generating member 103*b* arranged within the supply roll 103. For this reason, the developer is conveyed in a state in which individual particles of carrier are comparatively dispersed, and a part thereof is flowed back on the upstream side in the conveying direction. When the toner 108 is supplied to the developer in this state, the toner 108 comes into contact with a portion of carrier whose surface is bare, and is frictionally charged to electrostatically adhere to the carrier surface. The toner which has come into contact with a portion in which toner already adhered on the carrier surface cannot be frictionally charged, and therefore, it does not adhere to the carrier. Also, the toner which has not been frictionally charged with carrier, but adhered to the carrier surface or toner surface by a non-electrostatic adhesive force is shaken off by vibration of the developer caused by a fluctuating magnetic field between the magnetic field generating member 103*b* and the developer reflux part 104. Since in this area B, the individual particles of carrier are in a comparatively dispersed state as described above, almost all the carrier surface is covered with the toner by passing through only once.

Figure 19:
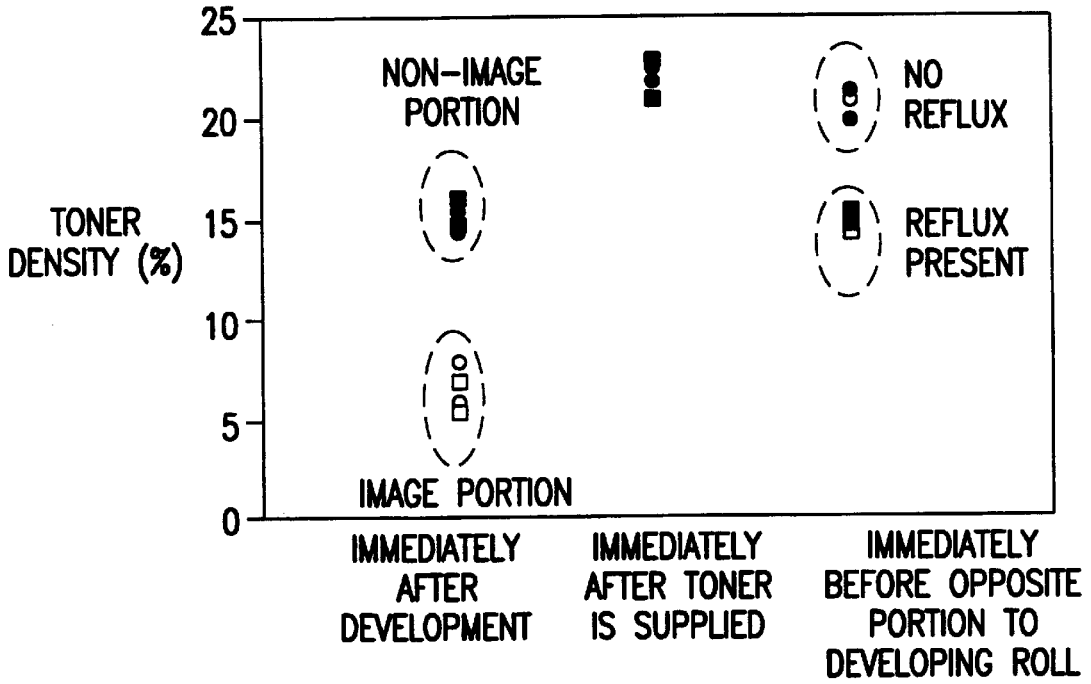
FIG. 19 is a view showing toner density in each process in a developing device according to the present invention.
Figure 20:
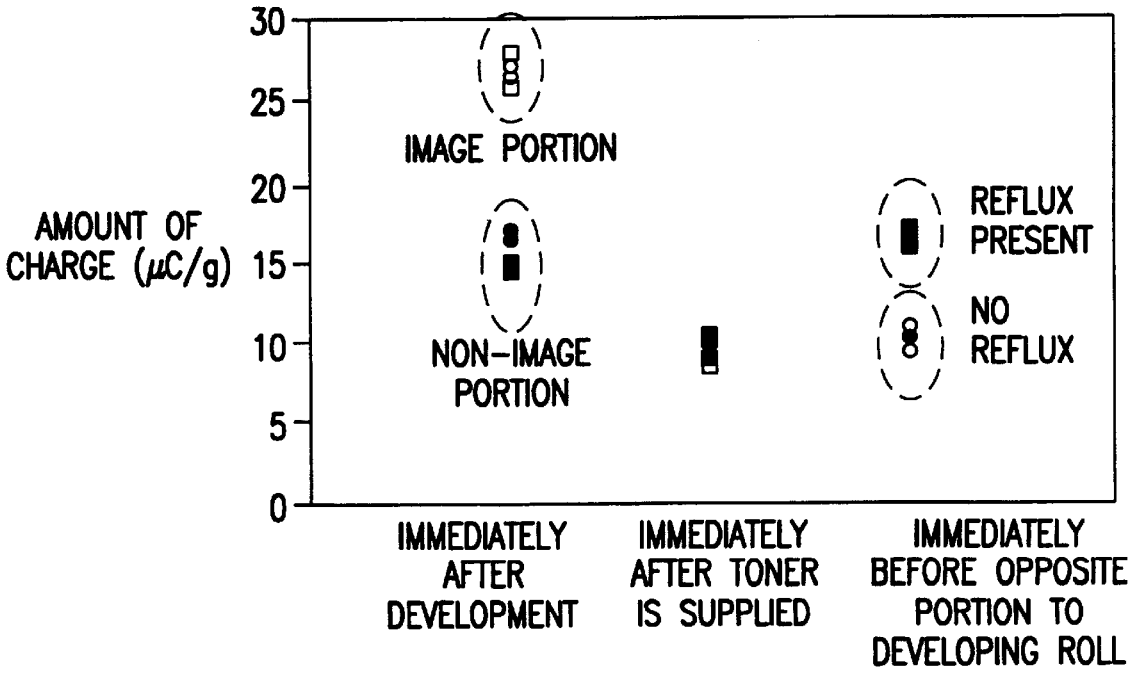
FIG. 20 is a view showing the amount of charge of toner in each process in a developing device according to the present invention.

FIGS. 19 and 20 are views showing changes in toner density and the amount of charge of toner when subjected to such developer reflux process as described above respectively.

From these figures, it can be seen that the amount of charge and toner density have substantially constant values by undergoing such a developer reflux process as described above irrespective of a portion (image portion) which contributed to development in the previous developing process before toner is supplied or a portion (non-image portion) which did not contributed and whatever the amount of charge of toner may be. Further, as compared with when the foregoing developer flow-back part is not provided, it can be seen that when this flow-back area is provided, any surplus toner is shaken off until a specified toner density is reached, and further the mount of charge has also been increased to a predetermined value. This is presumed to be because by the passage through the reflux area, the developer is disturbed and toner having a low amount of charge is selectively shaken off, and further because toner and carrier enter a more-dispersed state during the reflux, and therefore, an opportunity of the two to contact with each other increases to promote frictional charging.

The developer, to which the toner 108 has been replenished as described above, is conveyed to the development area opposite to the developing roll 102 again. At this time, since the sleeve 103*a* and the magnetic field generating member 103*b* rotate in the directions indicated by arrows in FIG. 3, the developer is conveyed in the rotating direction of the sleeve 103*a*, and the toner is uniformly dispersed by the tumbling and agitating operations of a chain of developer which has become bristle-shaped.

More specifically, a bristle-shaped chain of magnetic carrier formed on the sleeve 103*a* collapses toward a magnetic pole, which is approaching by the rotation of the magnetic field generating member 103*b*, and the next moment, it is caused to stand erect like a bristle on the magnetic pole. And, it collapses toward the next magnetic pole approaching, and stands erect like a bristle again—the so-called tumbling is repeated, whereby it is conveyed in the direction opposite to the direction of rotation of the magnetic field generating member 103*b*. Also, it is sufficiently agitated by such rolling.

In this respect, in the foregoing developing device, the sleeve 103*a* and the magnetic field generating member 103*b* rotate in the directions opposite to each other, but may rotate in the same direction. It will suffice only if they are rotated so as to relatively move the peripheral surface. Also, it may be possible to fix the sleeve 103*a* to prevent it from rotating.

In such conveyance of developer, each magnetic pole of the magnetic field generating member 103*b* is magnetized such that the interval P between the magnetic poles satisfies the following relation:

$$0.12\ \text{mm} \leqq P \leqq 6\ \text{mm}$$

and the strength of the magnetic pole or the amount of developer charged into the developing device is preferably set such that the layer thickness D of a developer layer formed on any portion other than the foregoing reflux area on the foregoing sleeve 103*a* by these magnetic poles satisfies the following relation:

$$D \leqq P/3$$

Such setting causes the foregoing tumbling to reach throughout the thickness of the developer layer on the sleeve 103*a*, enabling conveying while the entire developer carried is being sufficiently agitated.

In contrast, when the magnetic pole interval P is 0.12 mm or less, it becomes difficult for such so-called tumbling as described above to occur, and when the magnetic pole interval P exceeds 6 mm, the tumbling does not reach throughout the thickness of the developer layer, but agitation will not be sufficiently performed in a portion close to the surface of the sleeve 103*a*. Also, even when the layer thickness of the developer layer exceeds ⅓ of the magnetic pole interval P, it has been experimentally confirmed that the lower portion of the chain of developer, which has become bristle-shaped, can not tumble, but it enters a state in which only the tip end portion of the bristle moves.

Further, in order to smoothly perform conveyance and agitation of the developer by means of such a supply roll as described above, it has experimentally been confirmed that each magnetic pole of the magnetic field generating member 103*b* has preferably maximum magnetic flux density of 10 mT to 80 mT, and that the magnetic carrier for use has preferably magnetization in a magnetic field of $10^6/(4\pi)$ A/m, set to 45 to about 360 KA/m.

FIGS. 5(A) to 5(D) schematically show formation, movement and disappearance of a developer bridge in a developer reflux area in a developing device according to the present embodiment.

In a case where a force of attraction acts between the magnetic field generating member 103*b* and a magnet member 104*b* as shown in FIGS. 5(A) to 5(D), a part of developer carried on the supply roll 103 forms a bridge with the magnet member 104*b*, and moves on the side of the magnet member 104*b*.

Figure 5A:
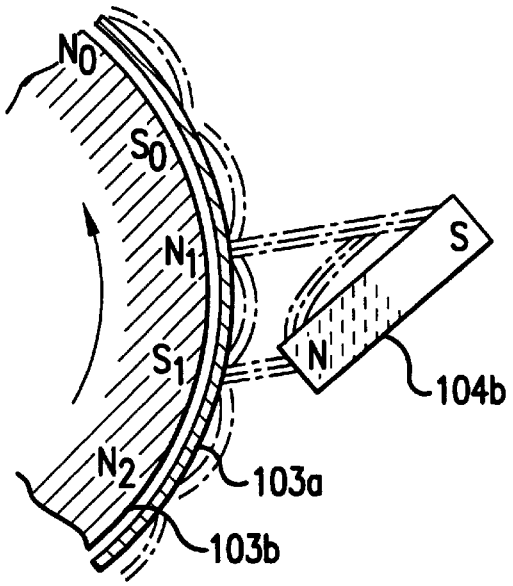
FIGS. 5(A) to 5(D) are views schematically showing formation, movement and disappearance of developer bridges in the developer reflux area in the developing device shown in FIG. 3.
Figure 5B:
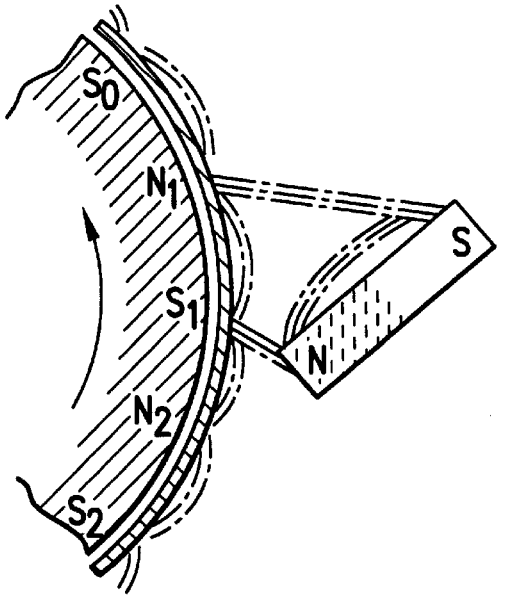
Figure 5C:
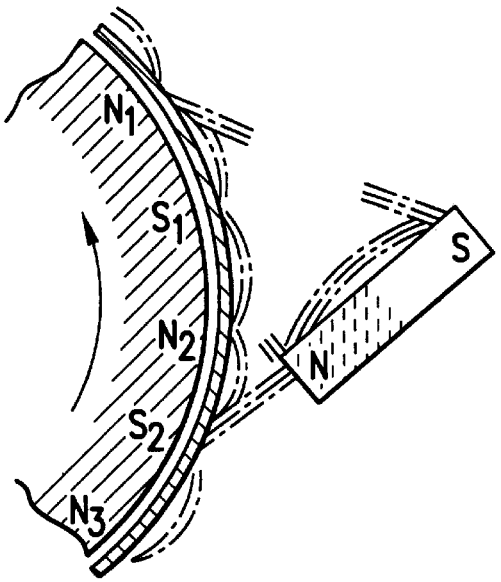
Figure 5D:
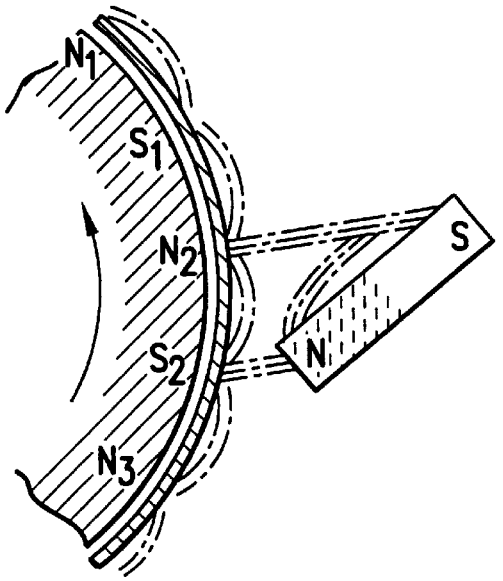

A bridge formed between $S_1$ pole of the magnetic field generating member 103*b* and N-pole of the magnet member 104*b* and a bridge formed between $N_1$ pole of the magnetic field generating member 103*b* and S-pole of the magnet member 104*b* as shown in FIG. 5(A) move in the direction of rotation of the magnetic field generating member 103*b* by the rotation thereof as shown in FIG. 5(B). Further, when the magnetic poles $S_1$ and $N_1$ of the magnetic field generating member 103*b* move, the foregoing bridge is cut as shown in FIG. 5(C), and a part of the developer which has formed the bridge between $S_1$ pole of the magnetic field generating member 103*b* and the magnet member 104*b* is once taken in the magnetic field between S-pole and N-pole of the magnet member 104*b*. The next moment, it becomes a part of a bridge to be formed between S-pole of the magnet member and $N_2$-pole of the magnetic field generating member 103*b* as shown in FIG. 5(D), and further is conveyed in the direction of rotation of the magnetic field generating member 103*b*. On the other hand, between N-pole of the magnet member 104*b* and the magnetic field generating member 103*b*, a bridge connected to the next $S_2$-pole approaching is formed as shown in FIG. 5(C), and is conveyed in the direction of rotation of the magnetic field generating member 103*b*.

In the reflux area, to which the supply roll 103 and the developer reflux part 104 oppose, there occur both such an operation as described above, and conveyance caused by the foregoing tumbling of britles of developer on the surface of the sleeve 103*a*. As a whole, as shown in FIG. 4, in the vicinity of the surface of the sleeve 103*a*, there occurs a flow in the direction opposite to the direction of rotation of the magnetic field generating member 103*b*, and in an area a little away from there, there occurs a flow in the same direction as the direction of rotation of the magnetic field generating member 103*b*. Thus, between these both flows, the developer is always mixed, and in the most upstream portion of the supply roll 103 in the developer conveying direction, the developer is mixed and dispersed as it is repelled by cutting of the bridge.

Such a series of movement is continuously performed by the rotation of the magnetic field generating member 103*b*, whereby the reflux and disturbance of developer are performed.

At this time, the magnetic pole interval of the magnetic field generating member 103*b*, the position of the magnet member 104*b* constituting the developer reflux part, and the strength of the magnetic poles are appropriately set, whereby at least one developer bridge is always formed on the downstream side in the conveying direction so that there occurs no clearance of the developer. For this reason, the toner is prevented from spilling in the conveying direction of the developer, and the occurrence of toner crowd can be suppressed.

This is for the following reason:

That is, when in the process of formation, movement and disappearance of a bridge, there is time in which no bridge is formed between the supply roll 103 and the developer reflux part 104, it enters a state in which there is a clearance between the foregoing both members, and surplus toner may leak in the conveying direction of developer by riding on a flow conveying the developer or by gravity. Such toner is mostly not sufficiently charged, but becomes crowded, and causes fog or the like on an image to be developed. In contrast, when at least one bridge is always formed, the toner, which is going to leak, can be taken in the developer, in which this bridge is formed, to flow back, and therefore, the toner is prevented from leaking.

In this respect, in order to form at least one bridge between the supply roll 103 and the developer reflux part 104 as described above, it is preferable that as in the case of a developing device according to the present embodiment, the foregoing developer reflux part has a smooth surface opposite to the peripheral surface of the foregoing developer supplying member, this opposite surface is formed so that it is brought closest to the developer supplying member on the downstream side of the foregoing supply roll in the developer conveying direction, and that the interval between the two is gradually enlarged on the upstream side in the developer conveying direction, and the foregoing magnet member is provided along this opposite surface.

Generally, when the interval between the supply roll 103 and the magnetic pole of the developer reflux part 104 is great, the length of the foregoing bridge becomes larger, and formation, movement and disappearance processes of the bridge are comparatively slowly performed. For this reason, although forces of the movement and reflux are great, some time lag is likely to occur between the disappearance and the formation, and as a result, a clearance of developer is likely to occur in the foregoing developer reflux area.

In contrast, there is provided an opposite surface such that it is positioned close to the supply roll on the downstream side of the supply roll in the developer conveying direction and that the interval is gradually enlarged on the upstream side as described above, and one magnetic pole is provided in a portion close, whereby a great reflux effect is provided, and a short bridge is formed between the supply roll and the developer reflux part in the portion close. In this way, the short bridge is newly formed one after another in a short time, and it becomes easy to cause at least one bridge to always exist in this portion.

Also, with the provision of the opposite surface as described above, it is possible to smoothly supply new toner to the reflux area of developer.

Also, the magnetic pole interval Pm in such a developer reflux part 104 as described above preferably satisfies the following relation with an interval P between the magnetic poles of the magnetic field generating member 103*b* which the supply roll 103 (developer supplying member) has:

$$Pm \geq \frac{1}{4}P$$

If with respect to the interval of the magnetic field generating member 103*b*, the magnetic pole interval of the magnet member 104*b* opposite is narrower than the range, which satisfies the foregoing relation, a range, in which the reflux of developer occurs, becomes very narrow, and no sufficient reflux can be obtained. Also, since the reflux occurs only closer to the peripheral surface of the supply roll 103, the developer is strongly affected by the magnetic poles of the magnetic field generating member 103*b*, and the bristle becomes difficult to collapse.

Next, the description will be made of an experiment conducted for investigating the relation between the magnetic pole interval of the magnetic field generating member and that of the magnet member, and the state of developer bridge.

Figure 21:
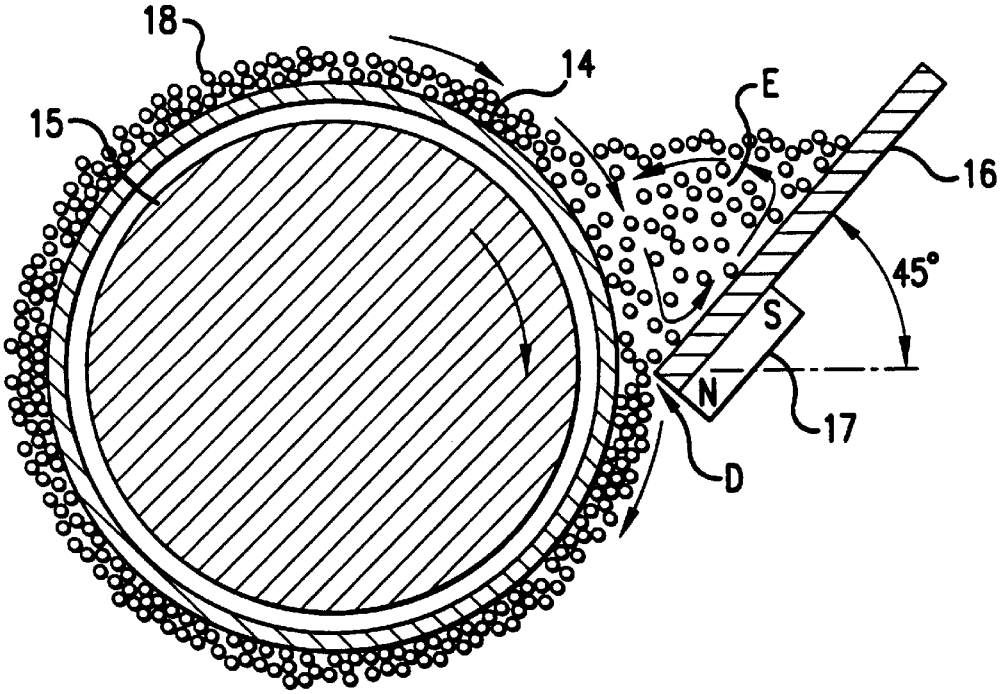
FIG. 21 is a schematic view showing an experimental device used in an experiment for confirming the effect of the present invention.

In this experiment, using developer consisting of non-magnetic toner having an average particle diameter of 7 $\mu$m, and ferrite carrier having an average particle diameter of 50 $\mu$m, and magnetization in a magnetic field of$10^6/(4\pi)$ A/m being within a range of 45 to 360 KA/m, the reflux of developer and behavior of the developer bridge were investigated in detail. FIG. 21 shows the outline of the experimental apparatus in this experiment.

First, at a point D on the peripheral surface of an endless sleeve 14 having an outside diameter of 36 mm, intersecting a horizontal line drawn through the center, a blade 16, whose tip end opposes at such a degree of appropriate distance that it does not come into contact with the developer layer 18 on the sleeve, is arranged in proximity at an angle of 45° with respect to the horizontal plane. On the back of the blade 16, a magnet 17 having a width of 0.5 mm to 7 mm and magnetized in the direction of the width is installed so that the direction of magnetization is in parallel to the blade 16 and that its one pole is located at the closest point on the blade 16 to the sleeve 14. Also, inside the foregoing sleeve 14, N-poles and S-poles are alternately magnetized with pitches of 1 to 11 mm at regular intervals, and a magnetic field generating member (magnet) 15 having the magnetic flux density of each magnetic pole, set to a range of 10 mT to 80 mT is rotatively supported. By varying the pitch of the magnetic poles of the magnetic field generating member 15 and the width of the magnet on the side of the foregoing blade 16, the relative relation in the magnetic pole interval was varied.

While the magnetic field generating member 15 is caused to rotate at 400 rpm with the sleeve 14 fixed, and toner is being supplied upstream of the opposite area, the aspect of the reflux and spilling of toner in the developer conveying direction in the opposite area E were observed. Also, in each condition for the magnetic field generating member 15 and the magnet 17, the state of the developer bridge was observed at the rotation of the magnetic field generating member 15 set to 10 rpm or less.

The result of this experiment is shown in Table 1. As regards reflux of developer, a case where, while reciprocating between the peripheral surface of the sleeve 14 and the blade 16, the developer in the former is replaced with the developer in the latter, and vice versa, and a phenomenon in which the developer is dispersed and circulated toward the upstream side is performed, is regarded as ○, and a case where the developer enters a clogged state or the conveyance on the sleeve 14 has not been collapsed, is regarded as ×. Also, as regards an item of spilt toner/developer, a case where spilling or scattering of toner or developer from the opposite area E toward the downstream side has not been observed is regarded as ○, and a case where it has been observed is regarded as ×. Also, as regards overall evaluation, an item having ○ for both is regarded as ○, and an item having × even for one is regarded as ×.

TABLE 1

| Magnetic pole pitch of internal member (mm) | Magnetic pole pitch of blade (mm) | Developer reflux | Number of developer bridges | Split toner/ developer | Overall evalu-ation |
|---|---|---|---|---|---|
| 1 | 0.5 | ○ | 2 | ○ | ○ |
| 1 | 1 | ○ | 2 | ○ | ○ |
| 1 | 3 | ○ | 2 | ○ | ○ |
| 1 | 5 | ○ | 2 | ○ | ○ |
| 1 | 7 | ○ | 1 | x | x |
| 1 | 10 | ○ | 1 | x | x |
| 3 | 0.5 | x | 0 | ○ | x |
| 3 | 1 | ○ | 2 | ○ | ○ |
| 3 | 3 | ○ | 2 | ○ | ○ |
| 3 | 5 | ○ | 2 | ○ | ○ |
| 3 | 7 | ○ | 1 | x | x |
| 3 | 10 | ○ | 1 | x | x |
| 5 | 0.5 | x | 0 | ○ | x |
| 5 | 1 | x | 0 | ○ | x |
| 5 | 3 | ○ | 2 | ○ | ○ |
| 5 | 5 | ○ | 2 | ○ | ○ |
| 5 | 7 | ○ | 2 | ○ | ○ |
| 5 | 10 | ○ | 1 | x | x |
| 8 | 0.5 | x | 0 | ○ | x |
| 8 | 1 | x | 1 | ○ | x |
| 8 | 3 | ○ | 2 | ○ | ○ |
| 8 | 5 | ○ | 2 | ○ | ○ |
| 8 | 7 | ○ | 2 | ○ | ○ |
| 8 | 10 | ○ | 2 | ○ | ○ |
| 11 | 0.5 | x | 0 | ○ | x |
| 11 | 1 | x | 0 | ○ | x |
| 11 | 3 | ○ | 2 | ○ | ○ |
| 11 | 5 | ○ | 2 | ○ | ○ |
| 11 | 7 | ○ | 2 | ○ | ○ |
| 11 | 10 | ○ | 2 | ○ | ○ |

As a result of the foregoing experiment, it is found that a reflux of developer occurs if the magnetic pole interval of a magnet exceeds ¼ of the magnetic pole pitch of the magnetic field generating member. Also, it is found that if the number of developer bridges is one, toner or developer will spill even if a reflux occurs, possibly causing an image quality defect. This is presumed to be because since the magnetic poles opposite to the sleeve are too far, the magnetic poles at a long distance cannot affect the magnetic poles of the magnetic field generating member to form no bridges, and because although a reflux is caused by the forgoing one bridge, a developer clearance occurs to cause the toner to spill during a time period from disappearance of a bridge to formation of the next bridge.

In this respect, the same result was obtained even in a case where the angle of the blade 16 and the position D of the closest point on the sleeve peripheral surface are varied.

Next, the similar observation was performed by fixing the magnetic pole pitch of the magnetic field generating member 15 to 3 mm, and the width of the magnet 17 to 3 mm, and varying the position at which the magnet 17 is installed to the blade 16.

Table 2 shows the result of this experiment. The installation position is represented by a distance from the closest point between the sleeve 14 and the blade 16 to the pole closer to the closest point. As the evaluation, this is nearly same as the foregoing evaluation, and the best one is resented by ⊙, and a good one by ○.

TABLE 2

| Installation position (mm) | Developer reflux | Number of developer bridges | Spilt toner/ developer | Overall evaluation |
|---|---|---|---|---|
| 0 | ◎ | 2 | ◎ | ◎ |
| 1 | ◎ | 2 | ○ | ○ |
| 3 | ○ | 2 | ○ | ○ |
| 5 | ○ | 1 | x | x |
| 7 | ○ | 1 | x | x |
| 10 | ○ | 1 | x | x |

As a result of this experiment, although a reflux occurs in either case, as the installation position separates from the closest point, a phenomenon of spilt toner was seen by reduction in developer bridges seen in the experiment shown in Table 1.

This is presumed to be because since a developer bridge on the further downstream side becomes too long, such time lag as described above occurs in the formation process, and a clearance, in which no developer exists, is caused between the developer layer on the peripheral surface of the sleeve 14 and the developer layer on the blade 16, and because of such reduction in developer bridges as seen in the experiment shown in Table 1.

From the foregoing result, it can be seen that the magnet 17 is preferably arranged such that the pole closer to the tip end of its blade is located in the vicinity of the closest position between the developer supply roll and the blade, and that a plurality of developer bridges can be formed.

In this respect, one magnet was used in this experiment. However, in order to cause a developer reflux on the peripheral surface of the supply roll, it is necessary that the magnetic pole interval of the magnetic field generating member in the supply roll and the interval of the poles of the magnet, which is the developer reflux part, satisfy the foregoing relation. In this case, a plurality of developer bridges are formed, and therefore, it may be possible to use two or more magnets, and arrange them spaced apart from each other.

Next, the description will be made of an experiment conducted for investigating the optimum values for the magnetic pole interval of the magnetic field generating member and the strength of the magnetic pole.

In this experiment, using developer consisting of non-magnetic toner having an average particle diameter of 7 $\mu$m, and ferrite carrier having an average particle diameter of 50 $\mu$m, and magnetization in a magnetic field of $10^6/(4\pi)$ A/m being within a range of 45 to 360 KA/m, this developer is attracted on the supply roll to investigate in detail a state in which the developer, which has become bristle-shaped, tumbles.

First, inside a cylindrical sleeve having an outside diameter of 36 mm, magnetic field generating members in which N-poles and S-poles are alternately arranged at pitches of 1 to 11 mm at regular intervals, having the magnetic flux density of each magnetic pole being within a range of 10 mT to 80 mT are inserted respectively, and the layer thickness of the developer was varied by varying the magnetic flux density of the magnetic field generating member and the amount of developer caused to adhere to the sleeve. In this respect, in this case, since no layer regulating member is used, the maximum layer thickness becomes the layer thickness on the magnetic pole.

Figure 22:
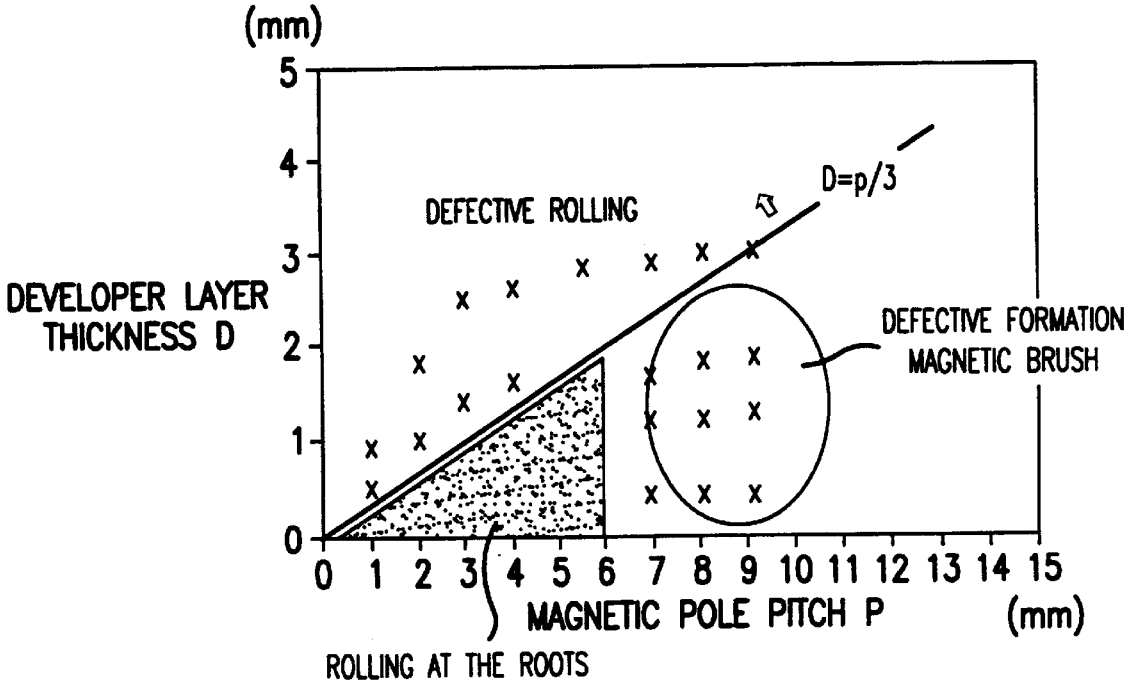
FIG. 22 is a view showing result of an experiment for investigating the relationship between a magnetic pole pitch of the supply roll or thickness of developer layer on the supply roll and an agitated state of the developer.

With the sleeve fixed, the magnetic field generating member was caused to rotate at a speed of 500 rpm to observe the tumbling of developer on the sleeve surface. FIG. 22 shows the result obtained by observing the maximum layer thickness (thickness of upper layer of magnetic pole) at each magnetic pole pitch and the tumbling due to the magnetic force of developer at the time.

As shown in FIG. 22, in an area where the magnetic pole pitch is 6 mm or less, tumbling at the root of a developer chain was observed when the developer layer thickness on the magnetic pole is ⅓ or less of the magnetic pole pitch. Also, when the developer layer thickness on the magnetic pole exceeds ⅓ of the magnetic pole pitch, the developer near the root of the developer chain can not tumble, but only the tip end portion of the developer chain moves, and it was observed that only the upper layer portion is agitated.

On the other hand, even in an area where the magnetic pole pitch exceeds 6 mm, the developer near the root of the developer layer becomes difficult to move, and tumbling becomes difficult to occur. Also, when the layer thickness is small, a portion, in which the developer is not attracted, occurs between the magnetic poles on the sleeve surface, and uniform magnetic brush cannot be formed.

From the foregoing result, it can be seen that in order to uniformly form chains, in which the developer has become bristle-shaped, on the sleeve, and to cause tumbling at the root, it is an optimum condition that the magnetic pole pitch is 6 mm or less, and the developer layer thickness on the magnetic pole is ⅓ or less of the magnetic pole pitch. In this respect, tumbling at the root of developer chain here means that the lower layer of the developer on the supply roll (developer supplying member) is replaced with the upper layer thereof by tumbling, and toner replenished is agitated so as to be uniformly dispersed.

FIGS. 6(A) to 6(D) are schematic cross-sectional views showing other examples of developer reflux part capable of being used in a developing device according to the present invention. Namely, in order to form a magnetic pole opposite to the developer supplying member, the blade 104*a* and a magnet 104*b* are used in the embodiment shown in FIG. 3, but those having such forms as shown in FIGS. 6(A) to 6(D) can be also adopted.

Figure 6A:
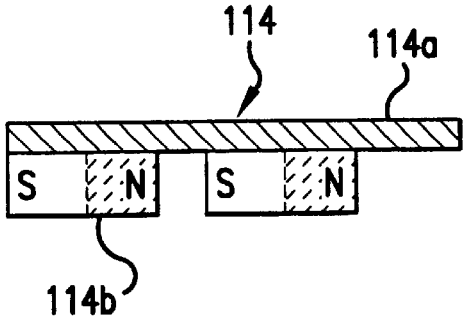
FIGS. 6(A) to 6(D) are schematic views showing other examples of developer reflux part used in a developing device according to an embodiment of the present invention.
Figure 6B:
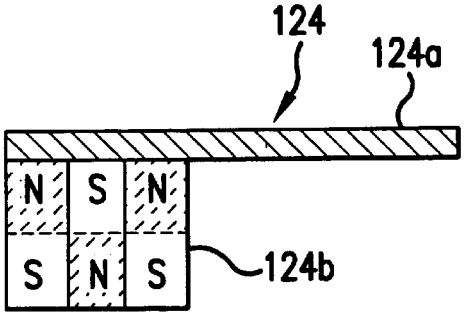

The developer reflux part 114 shown in FIG. 6(A) is obtained by arranging two magnet members 114*b* in series, each comprising a plate-shaped member made of ferrite magnetized in the direction of the width, on the back of the blade 114*a* made of non-magnetic stainless steel. Also, as shown in FIG. 6(B), the magnets 124*b* similarly magnetized may be arranged in parallel along the back of the non-magnetic blade 124*a*. The developer reflux part 134 shown in FIG. 6(C) has a continuous plate-shaped magnet member 134*b* made of ferrite on the back of the non-magnetic blade 134*a*, and on the surface of the magnet member, a plurality of N-poles and S-poles are magnetized respectively. The direction of magnetization of these magnetic poles is substantially parallel with the surface of the magnet member 134*b*. The developer reflux part 144 shown in FIG. 6(D) is obtained by arranging a plate-shaped member made of ferrite on the back of the non-magnetic blade 144*a*, and providing a plurality of magnetic poles by magnetizing in the direction perpendicular to the surface of this member.

These magnetic poles are preferably uniformly magnetized in the axial direction of the developer supplying member, that is, in a direction perpendicular to the plane of FIGS. 6(A) to 6(D). Also, there may be used a developer reflux part obtained by magnetizing so that N-poles and S-poles are alternately arranged for each predetermined width in the axial direction of the developer supplying member (supply roll 103) like the developer reflux part 154 shown in FIG. 7.

Figure 6C:
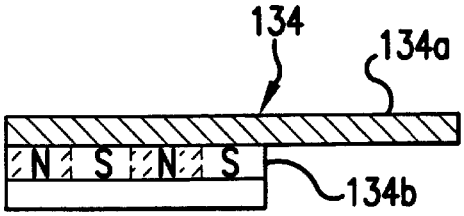
Figure 6D:
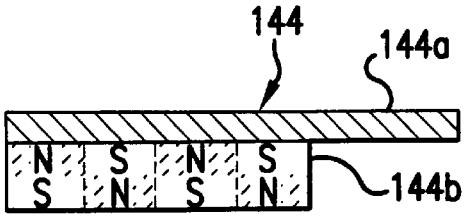
Figure 7:
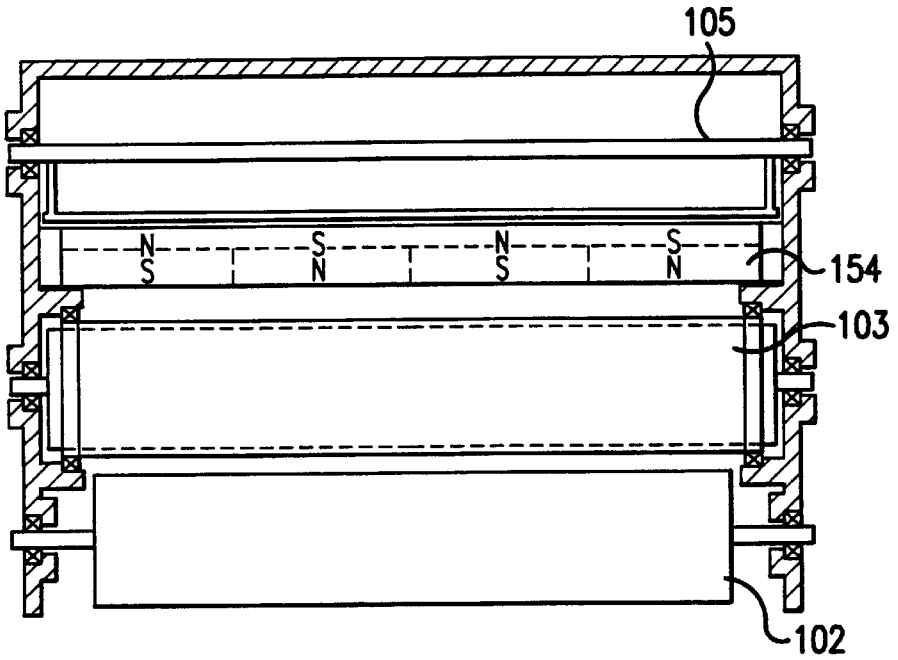
FIG. 7 is a schematic view showing another example of developer reflux part used in a developing device according to an embodiment of the present invention.

In this respect, a developing device using the developer reflux part shown in FIG. 6(C) or FIG. 6(D) shows an embodiment of the invention specified in claim 8.

Even when such a developer reflux part as described above is used, the reflux and disturbance of developer are effectively performed in the same manner as in the embodiment shown in FIG. 4, and the toner density and the amount of charge of toner after the passage through the reflux area become substantially constant.

Figure 8:
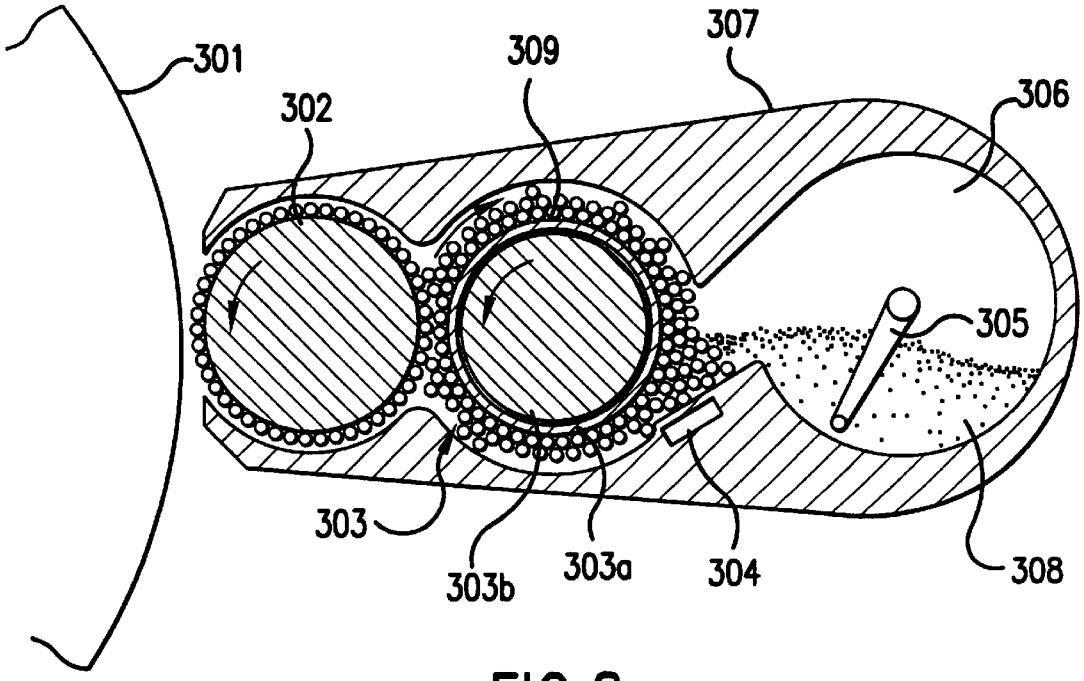
FIG. 8 is a schematic structural view showing a developing device according to an embodiment of the present invention.

FIG. 8 is a schematic structural view showing a developing device according to another embodiment of the invention specified in claims 1 to 7, claim 9, claim 10 or claim 11.

In the present embodiment, as a member opposite to the supply roll 303, no blade is provided, but an internal wall, opposite to the supply roll 303, of the housing 307 in the developing device is a surface opposite to the developer supplying member, and a magnet member 304 is provided behind the internal wall. The arrangement of the magnetic poles in the magnet member 304 is set in the same manner as in the developer reflux part shown in FIG. 4. The other structure is the same as in the developing device shown in FIG. 3.

Even in such a developing device, the reflux and disturbance of developer are effectively performed likewise in the reflux area, and the toner density and the amount of charge of toner after the passage through the reflux area become substantially constant.

Figure 9:
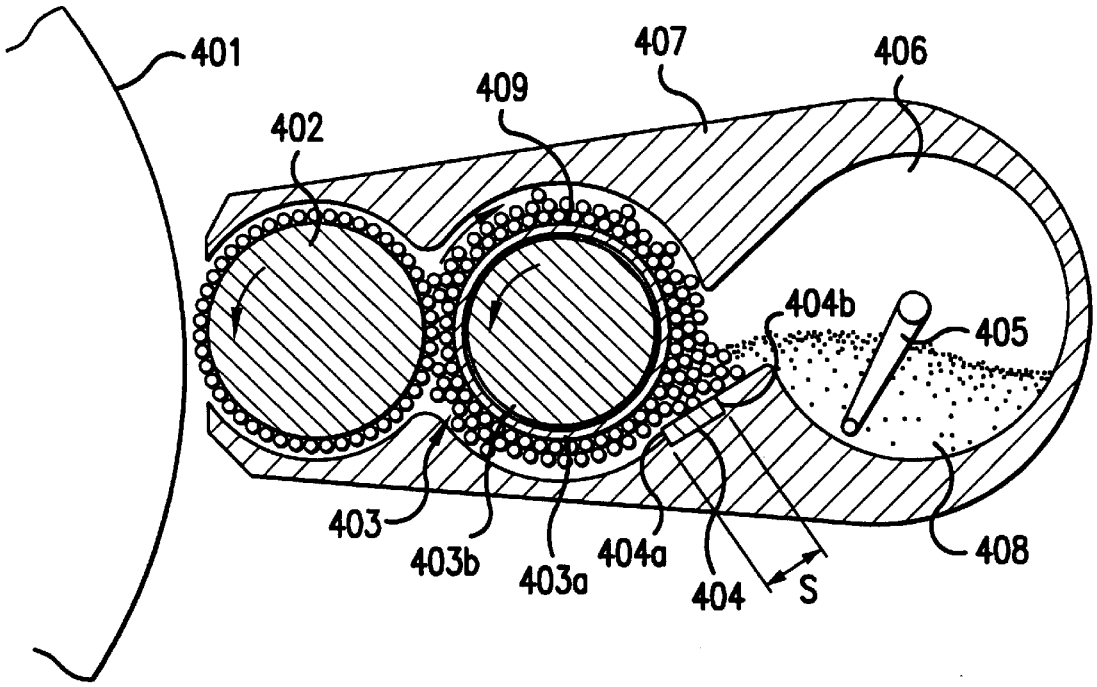
FIG. 9 is a schematic structural view showing a developing device according to an embodiment of the present invention.

FIG. 9 is a schematic structural view showing a developing device according to one embodiment of the invention specified in claims 1 to 5, claim 12, claim 13, claim 14 or claim 15.

This developing device comprises the same developing roll 402, supply roll 403 and toner conveying member 405 as in the device shown in FIG. 3, but as the developer reflux part, a blade 404 made of magnetic stainless steel is used. This blade 404 is arranged so as to oppose in parallel to the shaft line of the supply roll 403, and one edge 404*a* thereof is close on the downstream side of the supply roll 403 in the developer conveying direction while the other edge 404*b* is located apart from the surface of the supply roll 403. The width (indicated by a symbol S in FIG. 9) of this blade 404 is set so as to satisfy the following relation with the interval P between the magnetic poles magnetized on the magnetic field generating member 403*b* of the supply roll 403:

$$S \geqq \tfrac{1}{4}P$$

and in this developing device, the width is the same as that of the magnet member 104*b* of the developing device shown in FIG. 3.

In such a developing device, by a magnetic field formed around the foregoing supply roll 403, magnetic poles are induced on the magnetic blade 404 so that S-pole and N-pole are developed near both edges 404*a* and 404*b* respectively. Thus, by means of a magnetic field between these magnetic poles and the supply roll 403, chains (bridges) of two-component developer are formed so as to span across them, and a reflux is caused by the rotation of the magnetic field generating member 403*b*.

As described above, the conveyance and reflux in the opposite direction of two-component developer on the peripheral surface of the supply roll 403 are performed as in the case of the developing device shown in FIG. 3, whereby uniformization of toner density and sufficient charging of toner are performed.

In this respect, this developing device has also the same effects of the following as the developing device shown in FIG. 3: to arrange the blade 404 so that at least one developer bridge is always maintained; to arrange one edge of the blade 404 close to the supply roll 403, and the other edge in a retracted position; and to adjust the width S of the blade 404, i.e., the interval between the magnetic poles induced.

Figure 10:
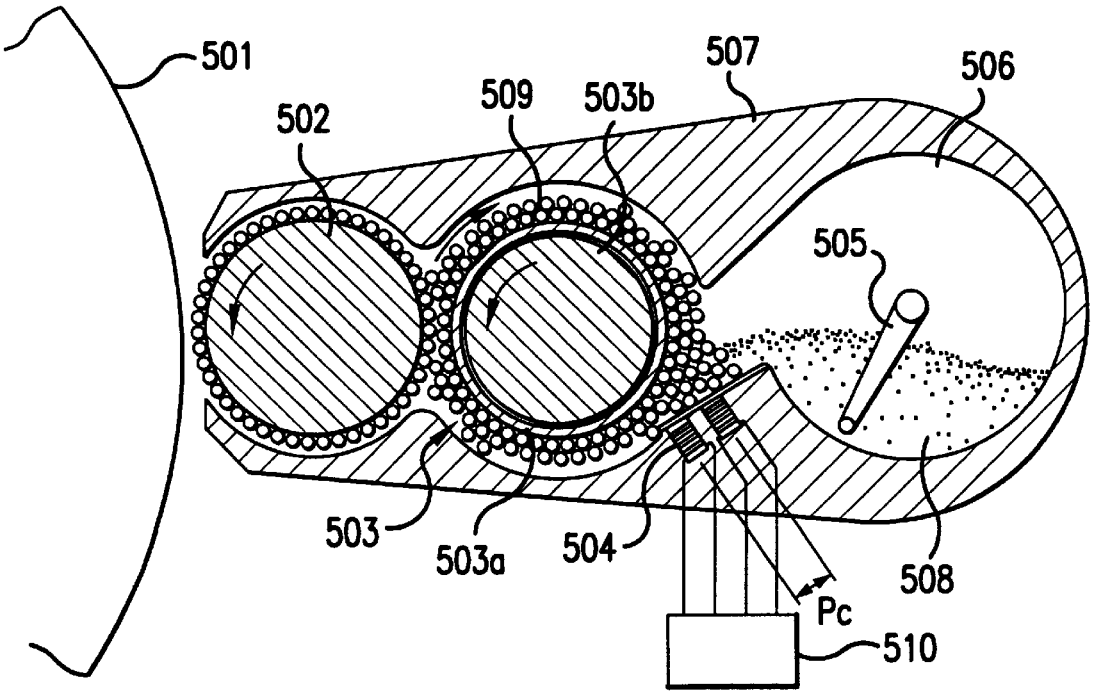
FIG. 10 is a schematic structural view showing a developing device according to an embodiment of the present invention.

FIG. 10 is a schematic structural view showing a developing device according to one embodiment of the invention specified in claims 1 to 6, claim 16, claim 17, claim 18 or claim 19.

In this developing device, there are arranged two electromagnets 504 at a position opposite to the supply roll 503 so that they are used as magnetic poles for causing developer to flow back by electrically energizing from power supply 510. The other structure of the developing device is the same as shown in FIG. 3.

Even in such a developing device, as in the case of the developing device shown in FIG. 3, the conveyance of two-component developer by the supply roll 503, and the reflux of developer by the electromagnets 504, which are a developer reflux part, are performed so that a good image can be obtained with stability using developer in which the toner is sufficiently charged with uniform toner density.

Also, in this developing device, it also becomes possible to promote the reflux by appropriately controlling the direction and timing of current conducting to the two electromagnets. In this respect, this developing device has the same effect of appropriately setting the relation between the interval (indicated by Pc in FIG. 10) between the magnetic poles, and the interval P of the magnetic poles magnetized on the magnetic field generating member 503*b* of the supply roll 503, or the arrangement positions of these electromagnets as the developing device shown in FIG. 3.

Figure 11:
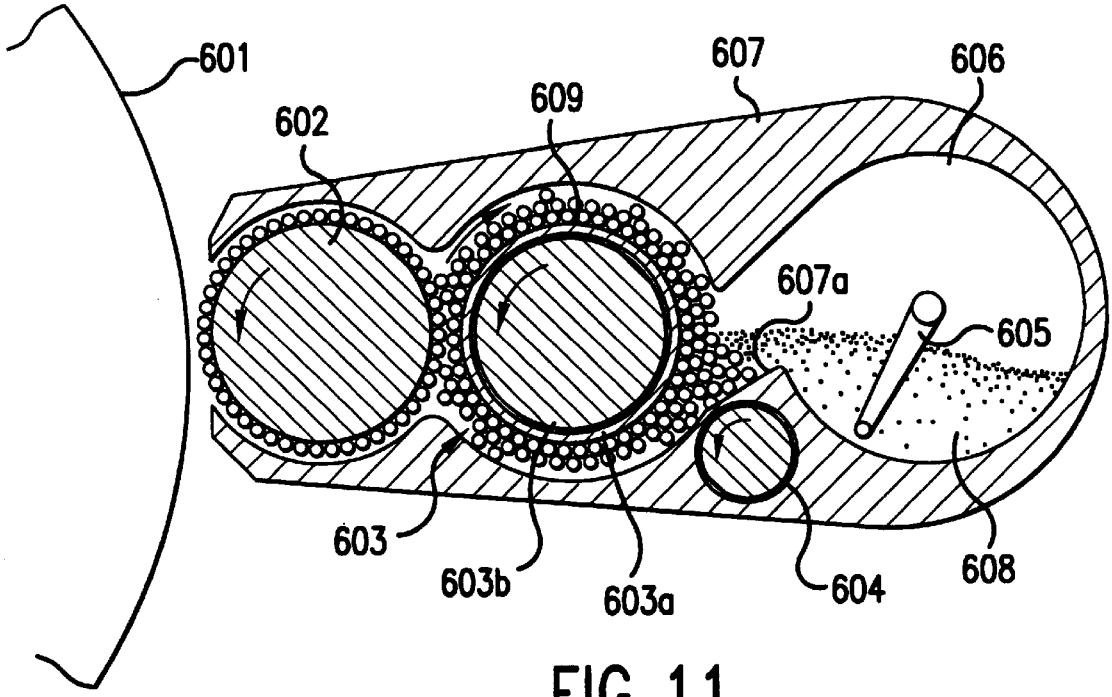
FIG. 11 is a schematic structural view showing a developing device according to an embodiment of the present invention.

FIG. 11 is a schematic structural view showing a developing device according to one embodiment of the invention specified in claims 1 to 6, claim 20 or claim 21.

In this developing device, an internal wall 607*a*, of a housing 607, opposite to a supply roll 603 is formed so as to approach the supply roll 603 on the downstream side in the developer conveying direction, and to enlarge the interval between the two on the upstream side. Behind the internal wall 607*a* (opposite surface) opposite, there is provided a magnet roll 604. This magnet roll 604 has N-poles and S-poles alternately magnetized on the peripheral surface, is rotatively supported, and has an outside diameter of 10 mm and a magnetization pitch of 5 mm.

This magnet roll 604 is rotated in a fixed direction, and a fluctuating magnetic field is formed between the magnet roll 604 and the supply roll 603 by means of the rotation of the magnet roll 604 and the rotation of a magnetic field generating member 603*b*. In this respect, the other structure of the developing device is the same as shown in FIG. 3. Also, in this developing device, the magnet roll 604 is rotatively supported, but it may have an independent driving system, or a driving system interlocked with the supply roll or the developing roll.

By such structure as described above, it is possible to cause an appropriate reflux of developer in the reflux area. The principle in which developer is caused to flow back by such a fluctuating magnetic field is the same as the content described concerning the developing device shown in FIG. 3.

Figure 12:
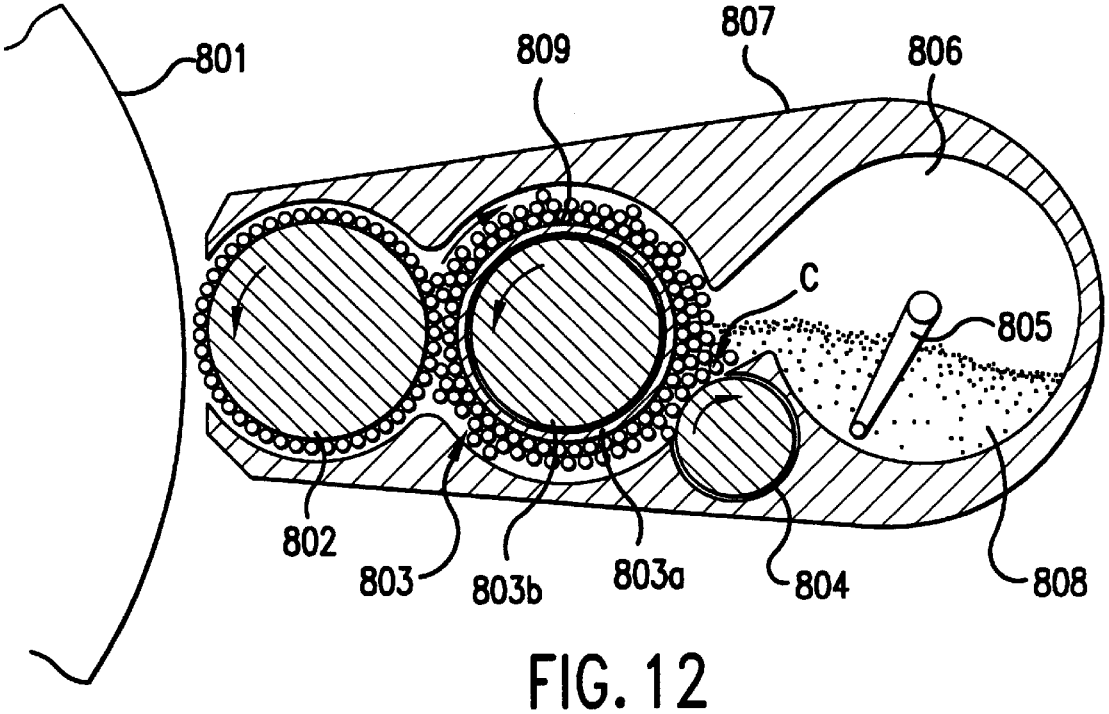
FIG. 12 is a schematic structural view showing a developing device according to an embodiment of the present invention.

FIG. 12 is a schematic structural view showing a developing device according to one embodiment of the invention specified in claims 1 to 5, claim 22 or claim 23.

This developing device comprises the same developing roll 802, supply roll 803 and toner conveying member 805 as in the device shown in FIG. 3, but as the developer reflux part, an opposite roll 804 having a driving system is provided at a position close to the supply roll 803. This opposite roll 804 is driven so that its peripheral surface comes into contact with developer conveyed on the sleeve 803*a* of the supply roll 803, and that it moves in the direction opposite to the conveyance direction of the supply roll. The opposite roll 804 conveys the developer which comes into contact with the developer 809 in an area indicated by C in the figure so as to sweep it out. The developer, which has been returned on the upstream side of the supply roll 803 in this way, is carried on the peripheral surface again by the magnetic force of the supply roll 803.

For the foregoing opposite roll 804, a rubber roller having elasticity is used, and its rotational speed is preferably 5 to about 20 rpm. This is because at 5 rpm or less, an amount of sweeping-out enough to cause reflux of developer cannot be provided, and at 20 rpm or more, the moving speed of the developer in the contact area C becomes high, and the contact pressure among developer particles becomes high, possibly resulting in deteriorated developer. In a developing device according to the present embodiment, the rotational speed is adjusted between 7 and 15 rpm.

By mechanically causing two-component developer conveyed on the supply roll 803 as described above to flow back, sufficient disturbance and frictional charging are performed, and developer sufficiently charged with uniform toner density can be used for development.

In this respect, it may be possible to provide a ferromagnetic material layer on the peripheral surface of the foregoing opposite roll or in the vicinity thereof, and to provide a multiplicity of magnetic poles at small pitches. In such an opposite roll, it is possible to effectively sweep out the developer in the moving direction of the peripheral surface with a magnetic attracting force. A developing device using such an opposite roll shows an embodiment of the invention specified in claim 25.

Figure 13:
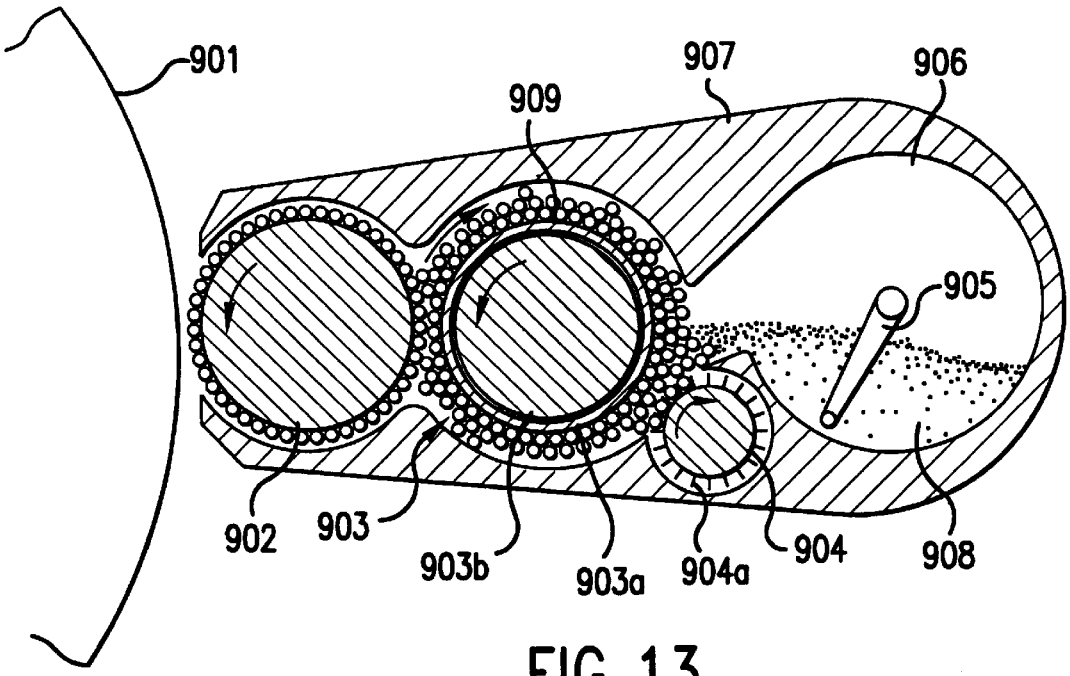
FIG. 13 is a schematic structural view showing a developing device according to an embodiment of the present invention.

FIG. 13 is a schematic structural view showing a developing device according to one embodiment of the invention specified in claims 1 to 5, claim 22, claim 23 or claim 24.

In this developing device, as in the case of the developing device shown in FIG. 12, an opposite roll 904 having a driving system is provided in proximity to a supply roll 903, and is driven so that the peripheral surface thereof moves in the direction opposite to the conveyance direction of developer on the sleeve 903*a* in the supply roll 903. Also, the opposite roll 904 has a plurality of wing-shaped projections 904*a* on its peripheral surface, and these projections 904*a* come into contact with a part of developer carried on the supply roll 903 to convey this developer on the upstream side of the supply roll 903 so as to push it out. The developer is returned on the peripheral surface again by the magnetic force of the supply roll 903, and a series of motions continue to thereby cause a reflux of the developer.

Figure 14:
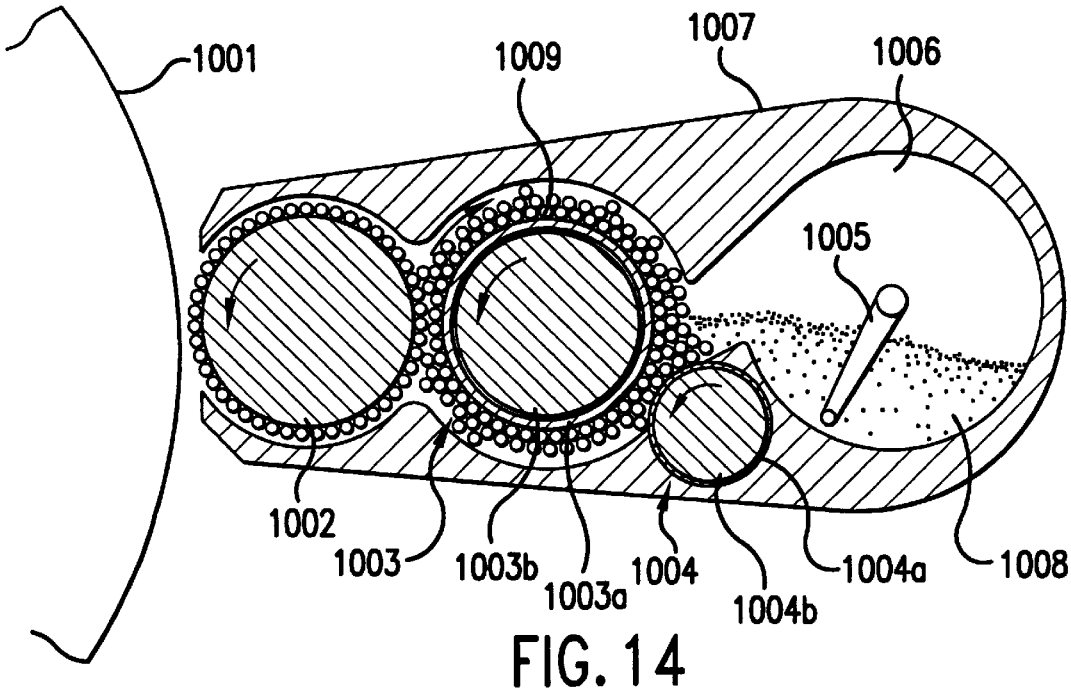
FIG. 14 is a schematic structural view showing a developing device according to an embodiment of the present invention.

FIG. 14 is a schematic structural view showing a developing device according to one embodiment of the invention specified in claims 1 to 5, or claim 26.

Even in this developing device, there is arranged an opposite roll 1004 in proximity to a supply roll 1003, and the opposite roll 1004 carries a part of developer on the peripheral surface thereof to convey it on the upstream side of the supply roll 1003. The opposite roll 1004 for use in this developing device is constituted by a hollow, cylindrical non-magnetic sleeve 1004*a* rotatively supported, and a magnetic field generating member 1004*b* located in the inside of the non-magnetic sleeve 1004*a*. This magnetic field generating member 1004*b* is provided so that magnetic poles having different polarities are alternately magnetized throughout the periphery, and that it can rotate independently of the sleeve 1004*a* outside.

The foregoing magnetic poles are magnetized at intervals of about 3 mm between N-poles and S-poles, and the maximum magnetic flux density (polar magnetic force) of each magnetic pole is 10 mT.

Also, the foregoing sleeve 1004*a* has an outside diameter of 10 mm, and is made of non-magnetic stainless steel.

On the other hand, for the supply roll 1003 for use in this developing device, the same one as the developing device shown in FIG. 3 is used, and the sleeve 1003*a* has an outside diameter of 18 mm, and is made of non-magnetic stainless steel. Also, the magnetic field generating member 1003*b* is provided such that 18 magnetic poles are placed at intervals of about 3 mm along the peripheral surface with N-poles and S-poles alternately magnetized, and the maximum magnetic flux density (polar magnetic force) of each magnetic pole is 30 mT.

This magnetic field generating member 1003*b* and the magnetic field generating member 1004*b* in the foregoing opposite roll 1004 are rotationally driven in the circumferential direction (in anti-clockwise direction in FIG. 14), and are driven in a portion to which both rolls oppose so that these peripheral surfaces move in the directions opposite to each other. These rotational speeds are 600 rpm and 50 rpm respectively, and the speeds are not limited to these speeds, but can be set within a range in which conveyance and reflux of developer occur.

In such a developing device, two-component developer attracted on the sleeve 1003*a* in the supply roll 1003 forms bristle-shaped chains, the rotation of the magnetic field generating member 1003*b* causes so-called tumbling—collapse and standing-erect of bristles are repeated—and the two-component developer is conveyed in the circumferential direction. Apart from such an operation, bristle-shaped chains of two-component developer are similarly formed also on the peripheral surface of the sleeve 1004*a* in the opposite roll 1004, are tumbled by the rotation of the magnetic field generating member 1004*b*, and are conveyed in the direction opposite to the conveyance direction of the foregoing supply roll 1003.

Therefore, in the opposite area to both rolls, the developer is disturbed by means of the conveyance of the developer on the peripheral surface of the supply roll, and the reflux in the opposite direction by the opposite roll so that uniformization of toner density and sufficient charging of toner are performed.

Figure 15:
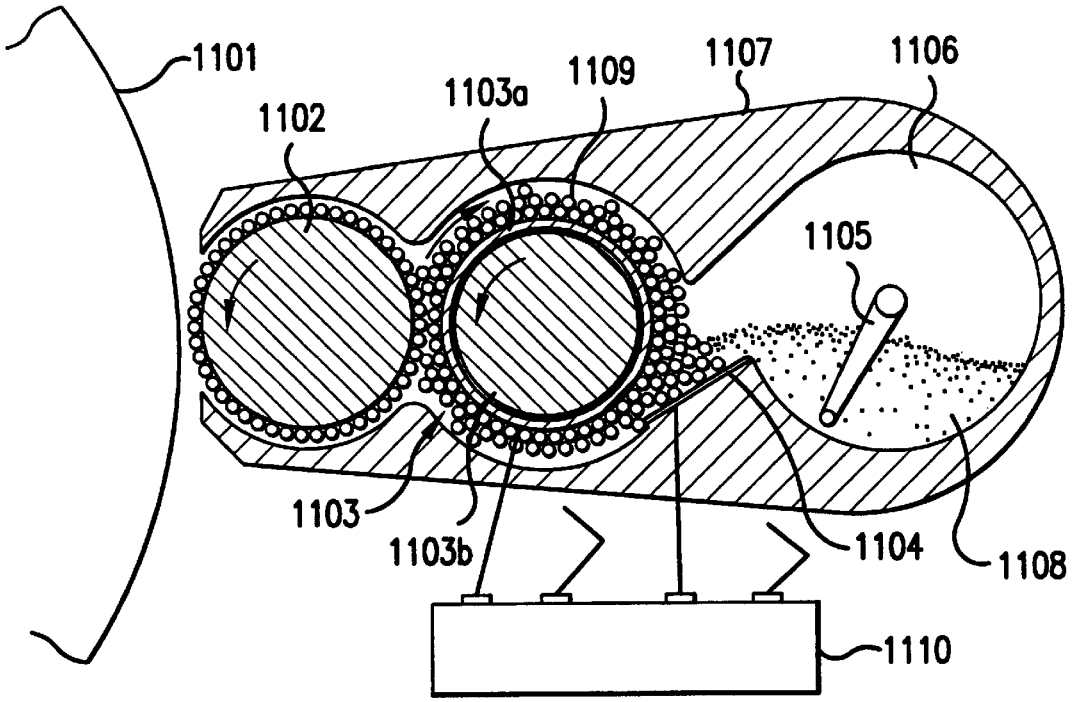
FIG. 15 is a schematic structural view showing a developing device according to an embodiment of the present invention.

FIG. 15 is a schematic structural view showing a developing device according to one embodiment of the invention specified in claims 1 to 5, or claim 27.

In this developing device, a supply roll 1103 is constituted by a hollow, cylindrical non-magnetic conductive sleeve 1103*a* rotatively supported, and a magnetic field generating member 1103*b* located in the inside of the sleeve 1103*a*. This magnetic field generating member 1103*b* is provided so that magnetic poles having different polarities are alternately magnetized throughout the periphery, and that it can rotate independently of the sleeve 1103*a* outside.

The foregoing conductive sleeve 1103*a* has an outside diameter of 18 mm, and is made of stainless steel. Also, on the peripheral surface of the magnetic field generating member 1103*b*, 18 magnetic poles are placed at intervals of about 3 mm with N-poles and S-poles alternately magnetized, and the maximum magnetic flux density (polar magnetic force) of each magnetic pole is 30 mT. The developer attracted on the sleeve by such magnetic poles has a thickness of 650 $\mu$m on the magnetic pole, and a thickness of 350 $\mu$m between the magnetic poles.

The foregoing sleeve 1103*a* and magnetic field generating member 1103*b* are the same as those used in the developing device shown in FIG. 3, but in the developing device shown in FIG. 3, the sleeve may not always be conductive whereas in this developing device, it is essential for the sleeve to be conductive.

Also, as the developer reflux part, there is arranged a conductive blade 1104 so as to oppose to the foregoing supply roll 1103, further, the foregoing conductive sleeve 1103*a* is maintained at a predetermined potential, and a power supply device 1110 for applying AC voltage between the sleeve and the foregoing conductive blade 1104 is provided.

The foregoing blade 1104 is provided such that with respect to the sleeve 1103*a* of the supply roll, the closest portion of the blade 1104 is located with one end thereof spaced apart a gap of 1 mm at a position at an angle of 45° below a line drawn horizontally from the center of the roll, and the angle of the blade is set to 45° with respect to the horizontal surface. The other structure of the developing device is the same as the developing device shown in FIG. 3.

In such a developing device, the developer conveyed on the supply roll 1103 is frictionally charged by contact between toner and carrier, and has charge. Thus, voltage of such a degree as to cause the developer to reciprocate appropriately is applied between the foregoing conductive sleeve 1103*a* and the blade 1104 by the foregoing power supply device 1110, whereby the developer leaves the bristle-shaped chains on the supply roll 1103, and enters a state in which the respective developer has dispersed.

By the rotation of the magnetic field generating member 1103*b* in the supply roll 1103, these dispersed developer undergoes the force of attraction from the magnetic poles to move in the direction of rotation. This moving direction becomes opposite to the direction in which the developer is conveyed while tumbling on the sleeve 1103*a* in the supply roll 1103, and conveyance of the developer on the supply roll 1103 and reflux in the opposite direction thereto are performed in an area to which the foregoing blade 1104 opposes. Thus, when the developer flowed back reaches a position immune to the magnetic field between the supply roll 1103 and the blade 1104, the developer is attracted to the sleeve 1103*a* again by the magnetic force of the foregoing magnetic field generating member 1103*b*.

Figure 16:
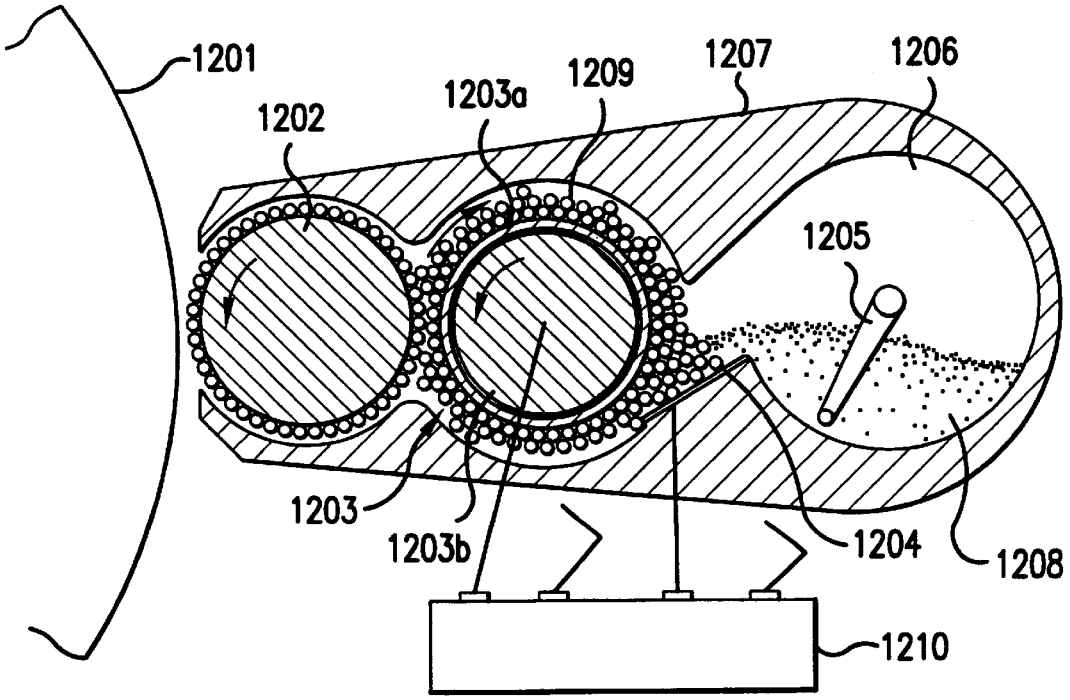
FIG. 16 is a schematic structural view showing a developing device according to an embodiment of the present invention.

FIG. 16 is a schematic structural view showing a developing device according to one embodiment of the invention specified in claims 1 to 5, or claim 28.

This developing device is, as in the case of the developing device shown in FIG. 15, such that a supply roll 1203 is constituted by a hollow, cylindrical non-magnetic sleeve 1203*a* rotatively supported and a magnetic field generating member 1203*b* arranged in the inside of the sleeve 1203*a*. The magnetic field generating member 1203*b* is, as in the case of the one shown in FIG. 15, magnetized, and is provided so as to be able to rotate independently of the sleeve 1203*a* outside, but one having a conductive layer in the vicinity of the peripheral surface is used.

In this respect, the foregoing sleeve 1203 has an outside diameter of 18 mm, and is made of stainless steel, and is the same as shown in FIG. 15.

Also, facing to the foregoing supply roll 1203, a conductive blade 1204 is arranged, the conductive layer of the foregoing magnetic field generating member 1203*b* is set to a predetermined potential, and there is provided a power supply device 1210 for applying AC voltage between the conductive layer and the foregoing conductive blade 1204.

Even in such a developing device, a vibrating electric field is formed between the supply roll 1203 and the blade 1204, and a part of two-component developer can be caused to flow back by the rotation of the magnetic field generating member 1203*b*.

Figure 17:
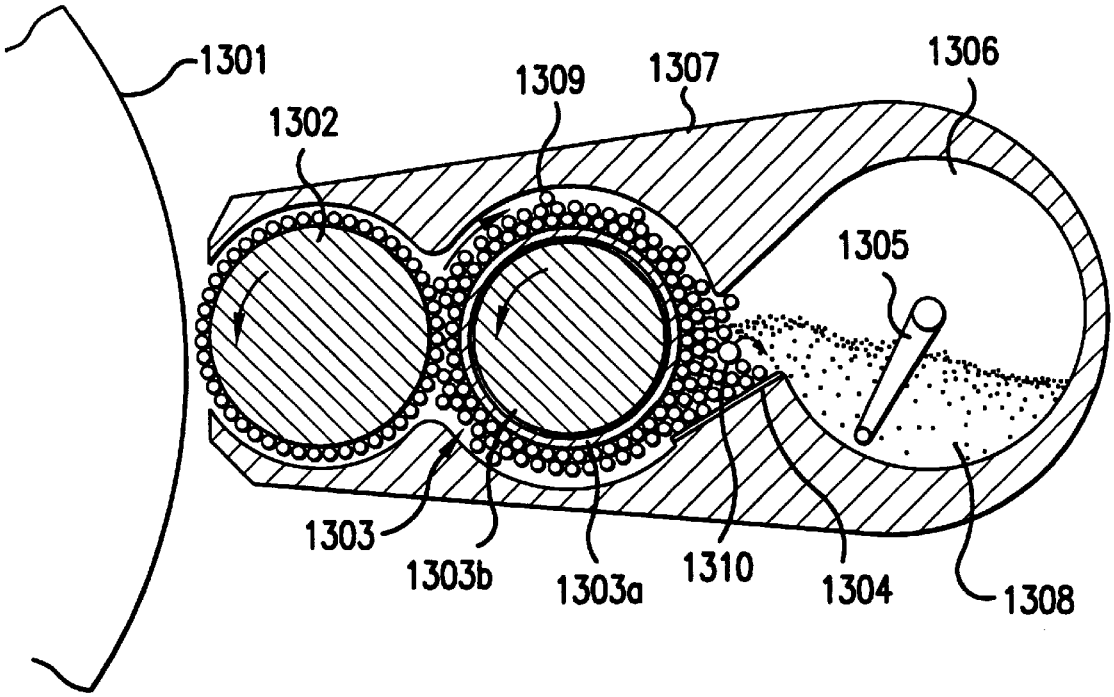
FIG. 17 is a schematic structural view showing a developing device according to an embodiment of the present invention.

FIG. 17 is a schematic structural view showing a developing device according to one embodiment of the invention specified in claim 29, claim 30, claim 31 or claim 32.

This developing device comprises: within a housing 1307 for containing two-component developer, a developing roll 1302 for carrying the two-component developer on the peripheral surface to convey it to an area opposite to a photoreceptor drum 1301; a supply roll 1303 for conveying the developer to a position opposite to the foregoing developing roll 1302 while mixing and agitating it to supply the developer to the foregoing developing roll; a blade 1304 as a developer hold-back member for collapsing a part of developer bristle on the supply roll 1303; a rotating member 1310 as a developer reflux part for causing the developer 1309 held back by the blade 1304 to flow back on the peripheral surface of the supply roll 1303; and a toner conveying member 1305 for conveying the toner 1308 to a reflux area B while loosening stored toner.

The foregoing supply roll 1303 is constituted by a hollow, cylindrical non-magnetic sleeve 1303*a* rotatively supported, and a magnetic field generating member 1303*b* located in the inside of the sleeve 1303*a*. This magnetic field generating member 1303*b* is provided such that magnetic poles having different polarities are alternately magnetized throughout the periphery and so as to be able to rotate independently of the sleeve 1303*a* outside.

The foregoing sleeve 1303*a* has an outside diameter of 18 mm, and is made of stainless steel. Also, on the peripheral surface of the magnetic field generating member 1303*b*, 18 magnetic poles are placed at intervals of about 3 mm with N-poles and S-poles alternately magnetized, and the maximum magnetic flux density (polar magnetic force) of each magnetic pole is 30 mT. The developer attracted on the sleeve by such magnetic poles has a thickness of 650 $\mu$m on the magnetic pole, and a thickness of 350 $\mu$m between the magnetic poles.

Both the magnetic field generating member 1303*b* and the sleeve 1303*a* rotate in the directions opposite to each other, whereby the developer chains, which have become bristle-shaped on the foregoing supply roll 1303, tumble in the direction opposite to the direction of rotation of the magnetic field generating member 1303*b*, and are conveyed to an area opposite to the developing roll 1302 while being agitated.

The foregoing blade 1304 is arranged so that its tip end comes below the center of the sleeve 1303*a*. In the present embodiment, the interval between the foregoing blade 1304 and the sleeve 1303*a* is set to 0.1 to 0.5 mm.

Also, the foregoing rotating member 1310 is a paddle-shaped member having small wings, and is rotationally driven so as to mechanically agitate the developer collapsed by the blade 1304, which is a hold-back member, and to cause a reflux within a range in which the magnetic force of the internal member 1303*b* in the supply roll reaches.

In such a developing device, by means of the blade 1304, which is a hold-back member, a portion of developer bristle is collapsed to cause it to stay and further the developer thus collapsed is caused to flow back, whereby the individual particles of carrier enter a comparatively-dispersed state, and a large carrier surface contactable with toner can be formed. At the same time, the rotation of the supply roll 1303 causes a magnetic field acting on the developer collapsed to always fluctuate and the developer enters an agitated state in the area where the developer has been collapsed.

Further, toner is supplied to the area where the developer is collapsed and flowed back, whereby the toner, which has contacted toner, is charged and attracted, and toner having low adhesive force with carrier is separated from the carrier by means of agitating operation of developer. Thus, the amount of toner adhering to carrier and the amount of charge of toner become substantially constant. In the area where the developer thus stays and is agitated, the developer flows back from the downstream side to the upstream side in the conveying direction thereof, whereby agitation in a wide range is performed to uniformize the toner density.

In this respect, the two-component developer used in this developing device is a mixture of non-magnetic polyester toner with ferrite magnetic carrier, but toner or carrier made of other material can be used. The carrier obtained by dispersing magnetic powder in polymer resin is smaller in specific weight than ferrite carrier, and has low stress during agitation, and it is preferable to reduce deteriorated developer. Toner formed by the polymerization method or the mixing and grinding method can be both used, and spherical toner with high fluidity is preferably used.

Figure 18:
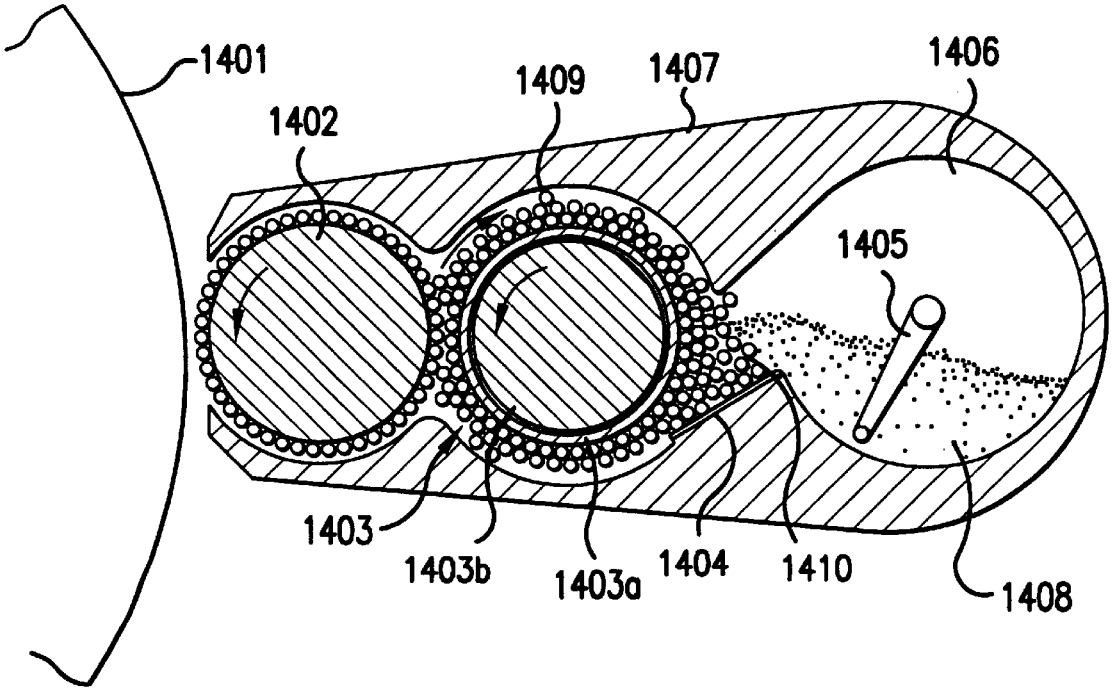
FIG. 18 is a schematic structural view showing a developing device according to an embodiment of the present invention.

FIG. 18 is a schematic structural view showing a developing device according to one embodiment of the invention specified in claim 29, claim 30, claim 31 or claim 33.

In this developing device, developer is held back by a blade 1404, which is a hold-back member, wire 1410, which is a developer reflux part, is tensioned so as to pass through the developer held back, and a magnetic field is caused in the vicinity thereof by conducting current from a power supply device (not shown).

The other structure of this developing device is the same as shown in FIG. 17. In such a developing device, current is caused to flow through the foregoing wire 1410 to thereby form a magnetic field in the circumferential direction in the vicinity thereof. This magnetic field causes a part of developer agitated in response to the rotation of the magnetic field generating member 1403*b* to be pulled back on the upstream side, thus causing a reflux.

In such a developing device, it is possible to adjust the amount of developer flowing back by causing a reflux after the hold-back, and this has an advantage that it is easy to control the amount of reflux.

All the developing devices according to an embodiment of the present invention described above use developing rolls of the same structure, and this developing roll will be described with reference to FIG. 3.

Figure 23:
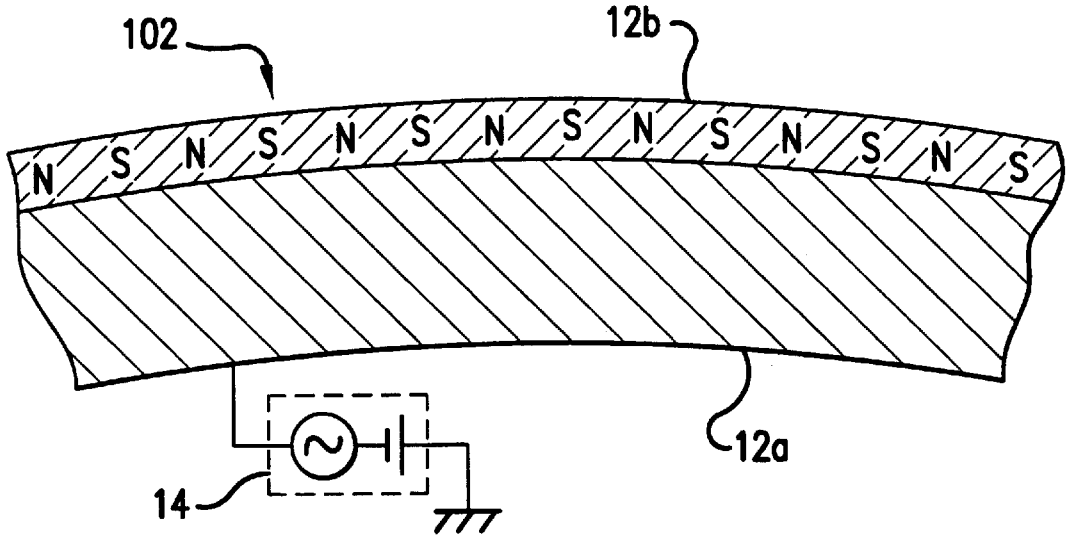
FIG. 23 is a partially enlarged view showing a developing roll preferably used in a developing device according to an embodiment of the present invention.

The foregoing developing roll 102 is mainly formed of a cylindrical, conductive substrate 12*a* supported so that the periphery of the shaft line can rotate, and a magnetic recording layer 12*b* formed on the peripheral surface thereof as shown in FIG. 23. In the present embodiment, the outside diameter of the developing roll 102 is set to 18 mm, the circumferential speed during driving, to 320 mm/s, and the clearance between the photoreceptor drum 101 and the developing roll 102, to 300 $\mu$m respectively, and a developer layer is maintained in a non-contact state with respect to the photoreceptor drum 101.

A developing bias voltage is applied to the foregoing conductive substrate 12*a* by power supply 14 for developing bias. For this developing bias voltage, AC voltage with DC voltage superimposed thereon is adopted, and the DC component is set to, for example, −400 V in order to prevent ground fog from occurring.

As regards AC component of the developing bias voltage, when the frequency is too low, density unevenness occurs in response to the frequency of the developing bias on the image. When the frequency is too high, toner movement cannot follow the variations in the electric field to lower the developing efficiency. On the other hand, when the peak-to-peak voltage of the AC bias is too low, a sufficient electric field does not act on the toner to lower the developing efficiency. Also, when the peak-to-peak voltage is too high, fog on the background portion or adhesion of carrier onto the photoreceptor easily occurs.

From the foregoing, it is preferable to set the frequency to a range of 0.4 to 10 kHz, and the peak-to-peak voltage to a range of 0.8 to about 3 kV.

In the present embodiment, the AC component of the developing bias voltage is a square wave of, for example, frequency of 6 kHz, and the peak-to-peak voltage is set to 1.5 kV.

On the other hand, the magnetic recording layer 12*b* is constituted by coating a product obtained by dispersing powdery body of ferromagnetic material in binding resin on a conductive substrate 12*a* at a layer thickness of 50 $\mu$m, and as the ferromagnetic material, $\gamma$-$Fe_2O_3$ is used, and as the binding resin, polyurethane is used. As this magnetic material, any material known as magnet material, magnetic recording material or the like can be used, and $CrO_2$ or the like can be used in addition to the foregoing $\gamma$-$Fe_2O_3$. Also, as the binding resin, any resin known as resin constituting a magnetic recording layer such as tape, disk, card and the like can be used, and for example, polycarbonate, polyester, polyurethane and the like can be used. Further, it is possible to add conductive particles or the like to the magnetic recording layer 12*b* as required.

This magnetic recording layer 12*b* is magnetized such that S-poles and N-poles are alternately arranged in parallel at regular microscopic intervals (25 to about 250 $\mu$m) in the circumferential direction throughout the periphery.

When developer is supplied to the developing roll 102 thus magnetized, a fixed amount of developer is attracted on the peripheral surface of the developing roll 102 on the basis of the magnetic field of the magnetic recording layer 12*b*. More specifically, only substantially one layer of carrier, which has electrically attracted toner, enters a substantially uniformly adhered state, and a uniform developer layer with a fixed layer thickness is formed even if any layer thickness regulating member is not used. This developer layer is conveyed to an area opposite to the photoreceptor drum 101 with the rotation of the developing roll 102, and is used to develop an electrostatic latent image on the photoreceptor drum 101.

Next, the description will be made of magnetization of the foregoing magnetic recording layer 12*b*. On magnetizing at microscopic intervals as described above, a magnetic recording head 13 shown in, for example, FIG. 24 can be used.

Figure 24:
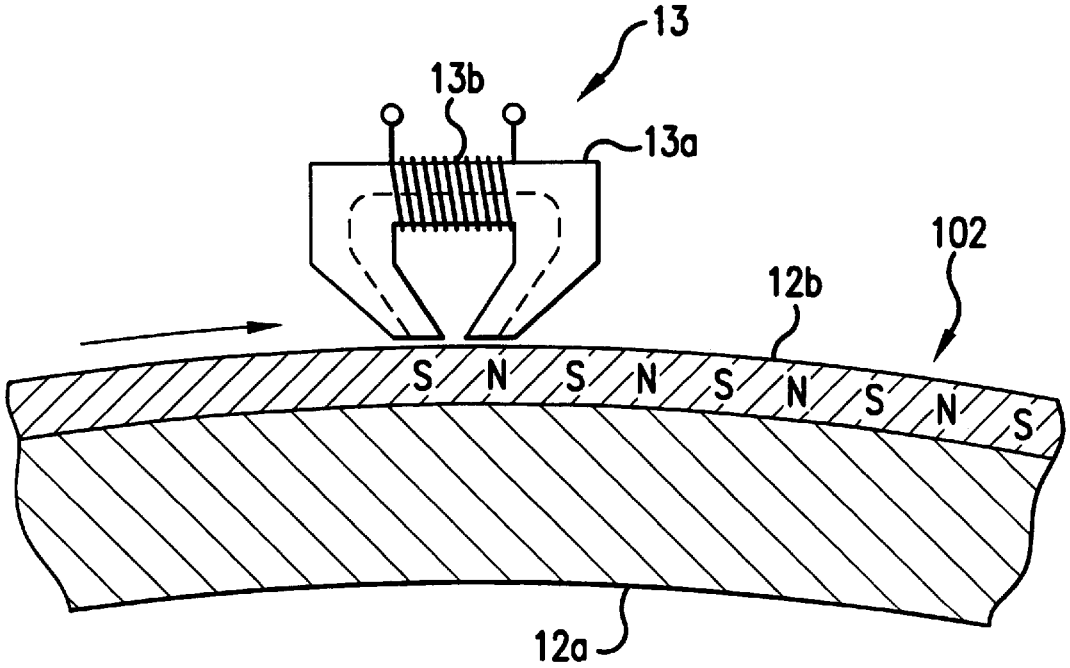
FIG. 24 is a view showing a magnetizing method for the developing roll shown in FIG. 23.
Figure 25:
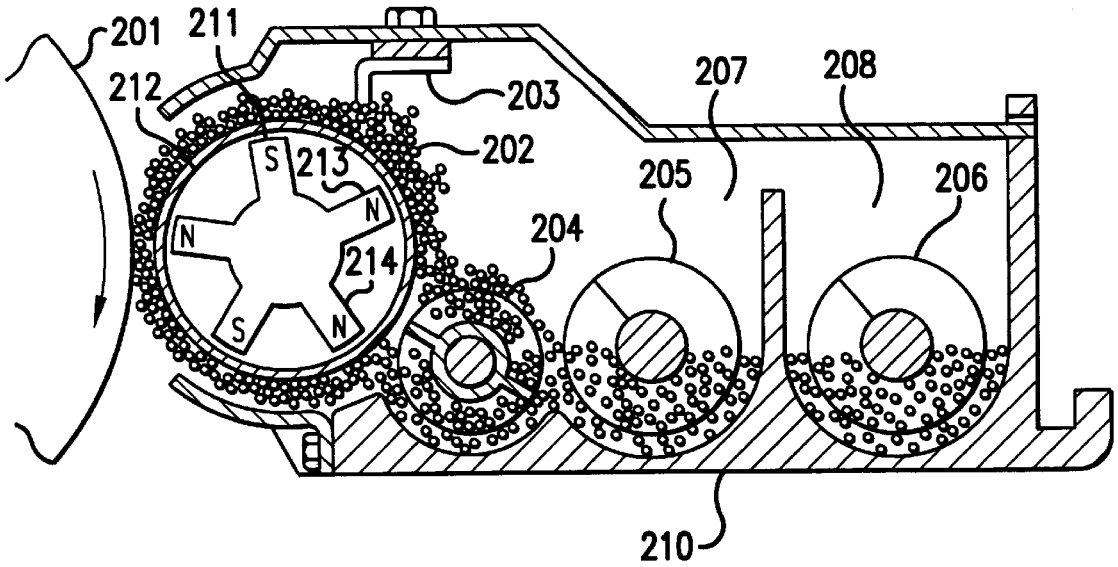
FIG. 25 is a partial structural view showing an example of conventional developing device.
Figure 26:
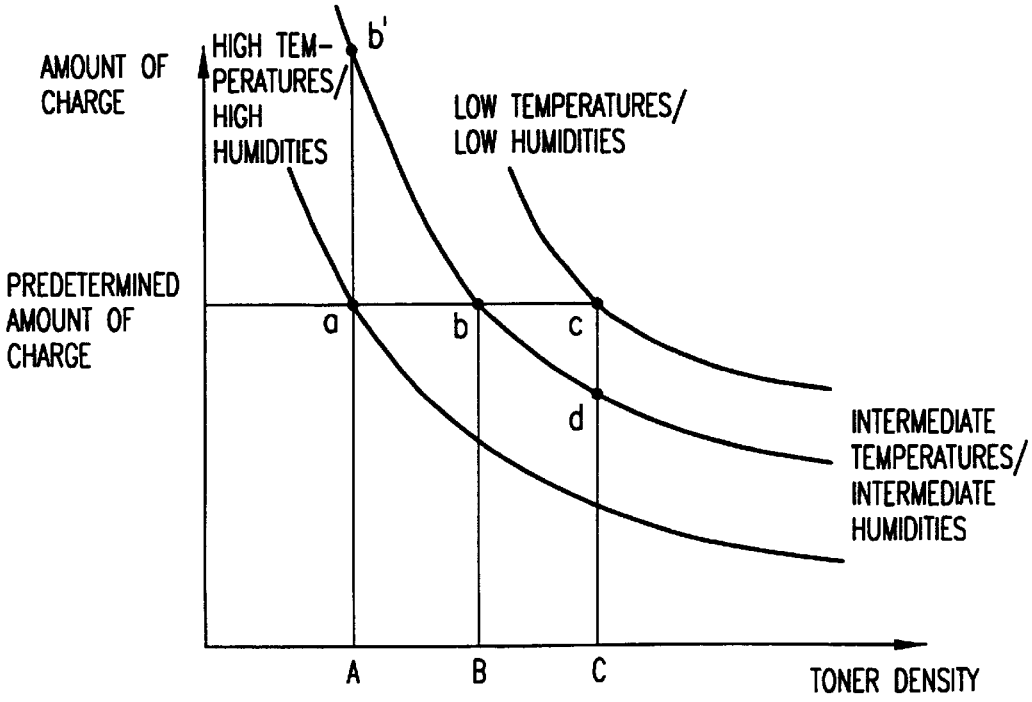
FIG. 26 is a view showing relationship between toner density and amount of charge of toner in the conventional developing device.

This magnetic recording head 13 is made of mild magnetic material, and comprises a core 13*a* of a shape in which both end portions are arranged in parallel manner spaced apart an interval, and a coil 13*b* wound around this core 13*a*, and is arranged such that the both end portions of the foregoing core 13*a* are in proximity to the peripheral surface of the developing roll. A magnetizing current from the power supply is adapted to be supplied to the coil 13*b* through a magnetizing signal generator, and when current flows through the coil 13*b*, magnetic flux 13*c* is generated within the core 13a, and this magnetic flux 13*c* passes through the magnetic recording layer 12*b* from the tip end of the core 13*a*. Thus, the magnetic recording layer 12*b* is magnetized. Magnetizing current supplied to the coil 13*b* is supplied through the magnetizing signal generator intermittently or by changing the direction of the current appropriately so that the peripheral surface of the developing roll 102, which is rotationally driven as shown in FIG. 24, is magnetized to a predetermined magnetizing pattern. In the present embodiment, alternate magnetization of N-poles and S-poles is performed as per a sine-wave pattern in the circumferential direction of the developing roll 102, and the peak value for magnetic flux density on the surface of the developing roll in the radial direction is set to 50 mT.

Effect of the Invention

As described above, in a developing device according to the present invention, two-component developer conveyed by carrying it on the peripheral surface of the developer supplying member having magnetic poles therein is caused to flow back on the upstream side in the conveying direction within a range in which the magnetic field by the magnetic poles of the developer supplying member reaches, whereby the developer can be dispersed and agitated in the portion. Therefore, it is possible to agitate the two-component developer, to which toner has been newly supplied, in the substantially entire reflux area for promoting frictional charging and uniformizing the toner density.

Also, when toner is supplied more than an amount of saturation which magnetic carrier is capable of electrically attracting, the toner is attracted up to the amount of saturation by contact between magnetic carrier and toner, and the toner having low adhesive force with the magnetic carrier is shaken off during the reflux. For this reason, it is possible to miniaturize and simplify the developing device, to maintain the toner density and the amount of charge of the two-component developer to be conveyed to the developing area substantially constant irrespective of environmental fluctuations, and to obtain an image with stable density over a long period of time.

What is claimed is:

1. A developing device for using two-component developer containing magnetic carrier and toner electrically attracted to said magnetic carrier and transferring said toner onto an electrostatic latent image formed on an image carrier for visualization, comprising:

a developing member for carrying said two-component developer or toner separated from said two-component developer on a peripheral surface, which circumferentially moves, to convey it to a position opposite to said image carrier, and transferring said toner onto an electrostatic latent image on said image carrier;

a developer supplying member provided to face said developing member, for conveying said two-component developer, in the circumferential direction, attracted onto said peripheral surface by a plurality of magnetic poles magnetized along the endless peripheral surface to supply said two-component developer or toner in said two-component developer to said developing member;

a developer reflux mechanism that flows back a part of said two-component developer carried on the peripheral surface of said developer supplying member upstream in the conveying direction within a range in which the attracting force of the magnetic poles, which said developer supplying member has, acts; and a toner supplying part that supplies toner to an area where said two-component developer is flowed back by said developer reflux part, or to that upstream thereof.

2. A developing device according to claim 1, wherein said toner supplying part supplies toner more than the amount of saturation which said carrier is capable of electrically attracting, to said two-component developer.

3. A developing device according to claim 1, wherein said developing member has a plurality of magnetic poles magnetized at substantially regular intervals on the peripheral surface thereof in such a manner that the interval between said magnetic poles is 25 $\mu$m–250 $\mu$m to attract substantially one layer of carrier on the peripheral surface of said developing member substantially uniformly.

4. A developing device according to claim 1, wherein:

said developer supplying member comprises: an internal member in which N-poles and S-poles are alternately magnetized over the entire circumference of its endless peripheral surface, and whose peripheral surface is supported so as to be able to circumferentially move; and an endless outer peripheral member supported in the outside of the peripheral surface of said internal member, said internal member is circumferentially driven so that said two-component developer layer, which has been magnetically attracted on the outer peripheral surface of said outer peripheral member, which is at rest or circumferentially driven, and has become bristle-shaped, is caused to be tumbled and agitated, and said two-component developer is conveyed in the circumferential direction, and said developer reflux mechanism forms a magnetic field fluctuating between said developer reflux mechanism and said developer supplying member to flow back said two-component developer by means of this fluctuating magnetic field.

5. A developing device according to claim 4, wherein each magnetic pole of the internal member in said developer supplying member is magnetized such that the interval P between the magnetic poles satisfies the following relation:

$$0.12\ \text{mm} \leqq P \leqq 6\ \text{mm}$$

and the strength of the magnetic pole or the amount of developer and the amount of developer flowed back by said developer reflux mechanism have been set by these magnetic poles such that the layer thickness D of two-component developer attracted on any portions other than the reflux area on said outer peripheral member due to said developer reflux mechanism satisfies the following relation $$D \leqq P/3.$$

6. A developing device according to claim 4, wherein said developer reflux mechanism has a plurality of magnetic poles provided in a position opposite to said developer supplying member along the circumferential direction thereof, and forms a magnetic field in which chains of said magnetic carrier are spanned like a bridge between these magnetic poles and magnetic poles of said internal member.

7. A developing device according to claim 6, wherein a plurality of magnetic poles which said developer reflux mechanism has are formed by arranging one or a plurality of magnets.

8. A developing device according to claim 6, wherein a plurality of magnetic poles which said developer reflux mechanism has are formed by magnetizing a plurality of N-poles and S-poles on one or a plurality of magnet members respectively.

9. A developing device according to claim 6, wherein:

said developer reflux mechanism has a smooth surface opposite to said developer supplying member in the circumferential direction, this opposite surface is formed such that it is brought closest to said developer supplying member downstream thereof in the developer conveying direction, and that the interval between the two is gradually enlarged upstream in said developer conveying direction, and said plurality of magnet poles are provided along said opposite surface.

10. A developing device according to claim 6, wherein said developer reflux mechanism forms a magnetic field in which at least one chain of said magnetic carrier spanned between said developer supplying member and said magnetic poles like a bridge is always maintained.

11. A developing device according to claim 6, wherein a plurality of magnetic poles of said developer reflux mechanism are provided such that the magnetic pole interval Pm of said developer reflux part and the interval P of the magnetic poles magnetized by the internal member of said developer supplying member in the circumferential direction satisfy the following relation:

$$Pm \geqq \frac{1}{4}P.$$

12. A developing device according to claim 4, wherein:

said developer reflux mechanism has a magnetic member provided along the circumferential direction of said developer supplying part to face thereto, magnetic poles are induced in said magnetic member by the magnetic poles of the internal member which said developer supplying member has, a magnetic field in which chains of said magnetic carrier are spanned like a bridge between these magnetic poles and the magnetic poles of said internal member is formed, and this magnetic field is fluctuated by circumferential movement of said internal member.

13. A developing device according to claim 12, wherein:

said developer reflux mechanism has a smooth surface opposite to said developer supplying member in the circumferential direction, this opposite surface is formed such that it is brought closest to said developer supplying member downstream thereof in the developer conveying direction, and that the interval between the two is gradually enlarged upstream in said developer conveying direction, and said magnetic member is provided along said opposite surface.

14. A developing device according to claim 12, wherein said magnetic member is arranged such that a magnetic field in which at least one chain of said magnetic carrier spanned like a bridge between said developer supplying member and said magnetic member is always maintained is formed.

15. A developing device according to claim 12, wherein the magnetic member of said developer reflux mechanism is provided such that the length S thereof opposite to said developer supplying member in the circumferential direction satisfies the following relation with the interval P, in the circumferential direction, between the magnetic poles magnetized on the internal member of said developer supplying member:

$$S \geqq \frac{1}{4}P.$$

16. A developing device according to claim 6, wherein a plurality of magnetic poles which said developer reflux mechanism has are formed by one or a plurality of electromagnets.

17. A developing device according to claim 16, wherein:

said developer reflux mechanism has a smooth surface opposite to said developer supplying member in the circumferential direction, this opposite surface is formed such that it is brought closest to said developer supplying member downstream thereof in the developer conveying direction, and that the interval between the two is gradually enlarged upstream in said developer conveying direction, and said plurality of electromagnets are arranged along said opposite surface.

18. A developing device according to claim 16, wherein in said developer reflux mechanism, current to the coils of said electromagnets is controlled such that a magnetic field in which at least one chain of said magnetic carrier spanned like a bridge between said developer supplying member and said magnetic poles is always maintained is formed.

19. A developing device according to claim 16, wherein a plurality of magnetic poles of the electromagnets which said developer reflux mechanism has are magnetized such that the interval Pc between these magnetic poles and the interval P, in the circumferential direction, of the magnetic poles magnetized on the internal member of said developer supplying member satisfy the following relation:

$$Pc \geqq \frac{1}{4}P.$$

20. A developing device according to claim 6, wherein:

a plurality of magnetic poles of said developer reflux mechanism are magnetized on the outer peripheral portion of a magnet member supported so as to be able to rotate around a shaft line parallel to the shaft line of said developer supplying member, and both the internal member of said developer supplying member and said magnet member rotate, whereby a fluctuating magnetic field is formed between them.

21. A developing device according to claim 20, wherein in said magnet member, the magnetic pole interval in the circumferential direction and the rotational speed are set such that at least one chain of said magnetic carrier spanned like a bridge between said developer supplying member and said magnet member is always maintained.

22. A developing device according to claim 1, wherein said developer reflux part is a rotating member which is opposite to said developer supplying member and is rotatably supported, and transfers the developer in contact with the outer peripheral portion of said rotating member upstream of said developer supplying member in the developer conveying direction.

23. A developing device according to claim 22, wherein said rotating member is a roll member supported so as to be able to rotate around the shaft line parallel to the shaft line of said developer supplying member.

24. A developing device according to claim 23, wherein said rotating member has a plurality of projections, on the peripheral surface, for pushing out developer in the moving direction of the peripheral surface.

25. A developing device according to claim 23, wherein said rotating member has a plurality of magnetic poles, in the vicinity of the peripheral surface, for moving together with said peripheral surface, and moves developer magnetically attracted onto said peripheral surface in the moving direction thereof.

26. A developing device according to claim 1, wherein:

said developer reflux part comprises: a roll-shaped internal member, over the entire circumference of which endless peripheral surface, S-poles and N-poles are alternately magnetized, and which has been supported so as to be able to rotate around a shaft line parallel to the shaft line of said developer supplying member; and an outer peripheral member provided along the peripheral surface of said internal member in the outside thereof, for opposing to said developer supplying member, and said internal member is rotationally driven such that the developer, which has been magnetically attracted onto the peripheral surface of said outer peripheral member, which is at rest or driven in the circumferential direction, and has become bristle-shaped, is conveyed while tumbling.

27. A developing device according to claim 1, wherein:

said developer supplying member comprises: an internal member, over the entire circumference of which endless peripheral surface, N-poles and S-poles are alternately magnetized, and whose peripheral surface is supported so as to be able to circumferentially move; and an endless, conductive outer peripheral member supported in the outside of the peripheral surface of said internal member, said internal member is circumferentially driven so that said two-component developer layer, which has been magnetically attracted onto the peripheral surface of said outer peripheral member, which is at rest or circumferentially driven, and has become bristle-shaped, is caused to be tumbled and agitated, and that said two-component developer is conveyed in the circumferential direction, said developer reflux mechanism comprises an electrode opposite to said developer supplying member, and power supply for applying AC bias voltage between this electrode and said conductive, outer peripheral member, and said bias voltage is set so that a part of the developer retracts from the developer layer, which has become bristle-shaped, and reciprocates between said electrode and said outer peripheral member.

28. A developing device according to claim 1, wherein:

said developer supplying member comprises: an internal member, over the entire circumference of which endless peripheral surface, which is constituted by conductive material at least in the vicinity of the peripheral surface, N-poles and S-poles are alternately magnetized, and whose peripheral surface is supported so as to be able to circumferentially move; and an endless, outer peripheral member supported in the outside of the peripheral surface of said internal member, said internal member is circumferentially driven so that said two-component developer layer, which has been magnetically attracted on the outer peripheral surface of said outer peripheral member, which is at rest or circumferentially driven, and has become bristle-shaped, is caused to be tumbled and agitated, and that said two-component developer is conveyed in the circumferential direction, said developer reflux mechanism comprises: an electrode opposite to said developer supplying member; and power supply for applying AC bias voltage between this electrode and a portion constituted by this electrode and the conductive material of said internal member, and said bias voltage is set so that a part of the developer retracts from the developer layer, which has become bristle-shaped, and reciprocates between said electrode and said outer peripheral member.

29. A developing device for using two-component developer containing magnetic carrier and toner electrically attracted to said magnetic carrier and transferring said toner onto an electrostatic latent image formed on an image carrier for visualization, comprising:

a developing member for carrying said two-component developer or toner separated from said two-component developer on the peripheral surface, which circumferentially moves, to convey it to a position opposite to said image carrier, and transferring said toner onto an electrostatic latent image on said image carrier;

a developer supplying member provided to face said developing member, for conveying two-component developer, in the circumferential direction, attracted onto said peripheral surface by a plurality of magnetic poles magnetized along the endless peripheral surface to supply it to said developing member;

a hold-back member provided to face the peripheral surface of said developer supplying member, for holding back at least a part of bristle of said two-component developer carried on the peripheral surface of said developer supplying member;

a developer reflux mechanism that flows back a part of said two-component developer held back by said hold-back member on the upstream side in the conveying direction within a range in which the attracting force of the magnetic poles which said developer supplying member has acts; and a toner supplying part that supplies toner to an area where said two-component developer is flowed back by said developer reflux mechanism, or on the upstream side thereof.

30. A developing device according to claim 29, wherein said toner supplying part supplies toner more than the amount of saturation which said carrier is capable of electrically attracting, to said two-component developer.

31. A developing device according to claim 29, wherein:

said developer supplying member comprises: an internal member, over the entire circumference of which endless peripheral surface, N-poles and S-poles are alternately magnetized, and whose peripheral surface is supported so as to be able to circumferentially move; and an endless outer peripheral member supported in the outside of the peripheral surface of said internal member, and said internal member is circumferentially driven so that said two-component developer layer, which has been magnetically attracted onto the outer peripheral surface of said outer peripheral member, which is at rest or circumferentially driven, and has become bristle-shaped, is caused to be tumbled and agitated, and said two-component developer is conveyed in the circumferential direction.

32. A developing device according to claim 29, wherein said developer reflux part is a rotating member, which has been supported so as to be able to rotate around a shaft line parallel to the shaft line of said developer supplying member, and comes into contact with the two-component developer held back by said hold-back member to flow back said two-component developer by rotational driving of said rotating member.

33. A developing device according to claim 29, wherein said developer reflux mechanism is an electrode member arranged substantially in parallel to the shaft line of said developer supplying member in the two-component developer held back by said hold-back member, and flows back said two-component developer by a magnetic field caused in the vicinity of said electrode member when voltage is applied across these electrodes.

* * * * *